US007597319B2

(12) United States Patent
Dangelewicz et al.

(10) Patent No.: US 7,597,319 B2
(45) Date of Patent: Oct. 6, 2009

(54) SHEET HANDLING USING A RAMP AND GRIPPERS ON AN ENDLESS BELT

(75) Inventors: John A. Dangelewicz, San Diego, CA (US); Kevin T. Kersey, San Diego, CA (US); Timothy J. Carlin, San Diego, CA (US); Geoffrey F. Schmid, San Diego, CA (US); Michael A. Novick, San Marcos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 405 days.

(21) Appl. No.: 11/133,891

(22) Filed: May 20, 2005

(65) Prior Publication Data

US 2006/0261536 A1 Nov. 23, 2006

(51) Int. Cl.
*B65H 29/70* (2006.01)

(52) U.S. Cl. ..... 271/188; 271/189; 271/198; 271/213; 271/307; 414/416.11

(58) Field of Classification Search ..... 271/306, 271/189, 198, 204, 307, 69, 188, 209, 147, 271/161, 213; 414/416.11, 797, 737, 416.07, 414/416.08, 416.09; 198/468.4, 468.8; 101/232; 399/393, 402, 405; 347/104; 400/624, 625
See application file for complete search history.

(56) References Cited

U.S. PATENT DOCUMENTS 2,600,028 A 6/1952 Steffen
3,147,850 A 9/1964 Ronceray
3,167,012 A * 1/1965 Claybourn ..... 101/416.1
3,236,357 A * 2/1966 Anderson et al. ..... 198/383
3,239,219 A * 3/1966 Reeves ..... 271/148
3,447,667 A 6/1969 Patz et al.
3,720,407 A * 3/1973 Woodward ..... 271/161
3,729,190 A * 4/1973 Harris et al. ..... 271/85
3,747,920 A * 7/1973 Linkus ..... 271/85
3,826,485 A 7/1974 Shindo
3,881,590 A 5/1975 Hartmann
3,891,204 A * 6/1975 Mager ..... 271/85
3,955,667 A * 5/1976 Muller et al. ..... 198/803.9
4,058,908 A 11/1977 Weber
4,083,556 A * 4/1978 Schilling et al. ..... 271/204
4,203,590 A * 5/1980 Blessing ..... 271/265.01
4,226,569 A * 10/1980 Gerard et al. ..... 414/737
4,303,152 A * 12/1981 Widmaier ..... 198/468.7

(Continued)

FOREIGN PATENT DOCUMENTS

DE 4434178 3/1996

(Continued)

OTHER PUBLICATIONS

International Search Report for PCT/US2006/019213 dated Sep. 22, 2006 (4 pages).

*Primary Examiner*—Patrick H Mackey
*Assistant Examiner*—Gerald W McClain

(57) ABSTRACT

An apparatus and method transport a sheet on a tray. In one embodiment, feet carried by an endless member contact a bottom and edge of the sheet to move the sheet off of the tray. In one embodiment, the sheet is arced while it is being engaged by the feet.

16 Claims, 11 Drawing Sheets

U.S. PATENT DOCUMENTS

| | | | | | |
|---|---|---|---|---|---|
| 4,311,304 | A | | 1/1982 | Hamada et al. | |
| 4,354,408 | A | * | 10/1982 | Carte | 83/162 |
| 4,400,124 | A | * | 8/1983 | Greller | 414/790.2 |
| 4,411,356 | A | * | 10/1983 | Radas | 198/721 |
| 4,469,026 | A | | 9/1984 | Irwin | |
| 4,479,645 | A | * | 10/1984 | Pollich | 271/183 |
| 4,505,375 | A | | 3/1985 | Kuster | |
| 4,516,762 | A | * | 5/1985 | Moltrasio et al. | 271/11 |
| 4,580,473 | A | * | 4/1986 | Seiden et al. | 83/23 |
| 4,624,455 | A | * | 11/1986 | Radek et al. | 271/85 |
| 4,753,429 | A | * | 6/1988 | Irvine et al. | 270/58.06 |
| 4,856,641 | A | * | 8/1989 | Matsumura et al. | 198/346.2 |
| 4,958,824 | A | * | 9/1990 | Willits et al. | 271/11 |
| 4,970,528 | A | | 11/1990 | Beaufort et al. | |
| 5,033,730 | A | | 7/1991 | Davies et al. | |
| 5,048,671 | A | | 9/1991 | Ellsworth | |
| 5,056,767 | A | * | 10/1991 | Emigh et al. | 270/58.01 |
| 5,056,773 | A | * | 10/1991 | Weisgerber | 271/204 |
| 5,082,271 | A | * | 1/1992 | Mohr | 271/161 |
| 5,083,763 | A | | 1/1992 | Hartta | |
| 5,096,370 | A | * | 3/1992 | Mohr | 414/789.1 |
| 5,123,639 | A | * | 6/1992 | Edwards | 271/212 |
| 5,238,240 | A | * | 8/1993 | Prim et al. | 271/299 |
| 5,244,294 | A | | 9/1993 | Ewing | |
| 5,396,270 | A | | 3/1995 | Gooray et al. | |
| 5,404,197 | A | | 4/1995 | Hicks | |
| 5,630,690 | A | * | 5/1997 | Salzman | 414/217.1 |
| 5,664,337 | A | * | 9/1997 | Davis et al. | 34/58 |
| 5,743,522 | A | * | 4/1998 | Rubscha et al. | 271/265.02 |
| 5,775,689 | A | * | 7/1998 | Moser et al. | 271/198 |
| 5,810,347 | A | * | 9/1998 | Wingate | 271/204 |
| 5,818,508 | A | | 10/1998 | Straayer et al. | |
| 5,836,736 | A | * | 11/1998 | Thompson et al. | 414/805 |
| 5,870,957 | A | * | 2/1999 | Muller | 101/484 |
| 5,890,821 | A | * | 4/1999 | Lesniak et al. | 400/625 |
| 5,899,453 | A | * | 5/1999 | Middelberg et al. | 271/184 |
| 5,954,473 | A | * | 9/1999 | Folsom | 414/788.9 |
| 5,966,903 | A | * | 10/1999 | Dudderar et al. | 53/397 |
| 5,975,521 | A | * | 11/1999 | Ono et al. | 271/188 |
| 6,120,143 | A | * | 9/2000 | Narushima et al. | 347/104 |
| 6,179,499 | B1 | * | 1/2001 | Beretta et al. | 400/605 |
| 6,203,617 | B1 | * | 3/2001 | Tanoue et al. | 118/695 |
| 6,352,253 | B1 | * | 3/2002 | Hayakawa et al. | 270/58.12 |
| 6,382,621 | B1 | * | 5/2002 | Inoue et al. | 271/120 |
| 6,457,414 | B1 | * | 10/2002 | Kato et al. | 101/477 |
| 6,471,205 | B2 | * | 10/2002 | Lautenklos et al. | 271/182 |
| 6,478,297 | B1 | * | 11/2002 | Messerschmid | 271/277 |
| 6,675,711 | B2 | * | 1/2004 | Kawamura et al. | 101/477 |
| 6,675,712 | B2 | | 1/2004 | Marincic et al. | |
| 6,701,841 | B2 | * | 3/2004 | Tsurumaki | 101/419 |
| 6,793,216 | B2 | * | 9/2004 | Nakamura | 271/188 |
| 6,833,035 | B1 | * | 12/2004 | Thompson et al. | 134/33 |
| 6,868,781 | B2 | * | 3/2005 | Dagher | 101/217 |
| 6,969,059 | B2 | * | 11/2005 | Gafner | 271/69 |
| 7,114,908 | B1 | * | 10/2006 | Sarver et al. | 414/790.2 |
| 7,263,327 | B2 | * | 8/2007 | Nagayama | 399/405 |
| 2001/0006272 | A1 | * | 7/2001 | Gunschera et al. | 271/213 |
| 2001/0015144 | A1 | * | 8/2001 | Tsurumaki | 101/232 |
| 2002/0088742 | A1 | * | 7/2002 | Wursthorn | 209/552 |
| 2002/0180142 | A1 | * | 12/2002 | Sisk | 271/198 |
| 2003/0173733 | A1 | * | 9/2003 | Ferus | 271/198 |
| 2005/0092581 | A1 | * | 5/2005 | Walker | 198/433 |
| 2006/0082044 | A1 | * | 4/2006 | Aida | 271/145 |
| 2006/0170148 | A1 | * | 8/2006 | Goh et al. | 271/145 |
| 2006/0209152 | A1 | * | 9/2006 | Baringa et al. | 347/104 |

FOREIGN PATENT DOCUMENTS

| | | | | |
|---|---|---|---|---|
| EP | 0278047 | | | 8/1988 |
| GB | 2077240 | | | 12/1981 |
| JP | 06191656 | A | * | 7/1994 |
| JP | 07033394 | A | * | 2/1995 |
| JP | 2003076032 | A | * | 3/2003 |

* cited by examiner

FIG. 10
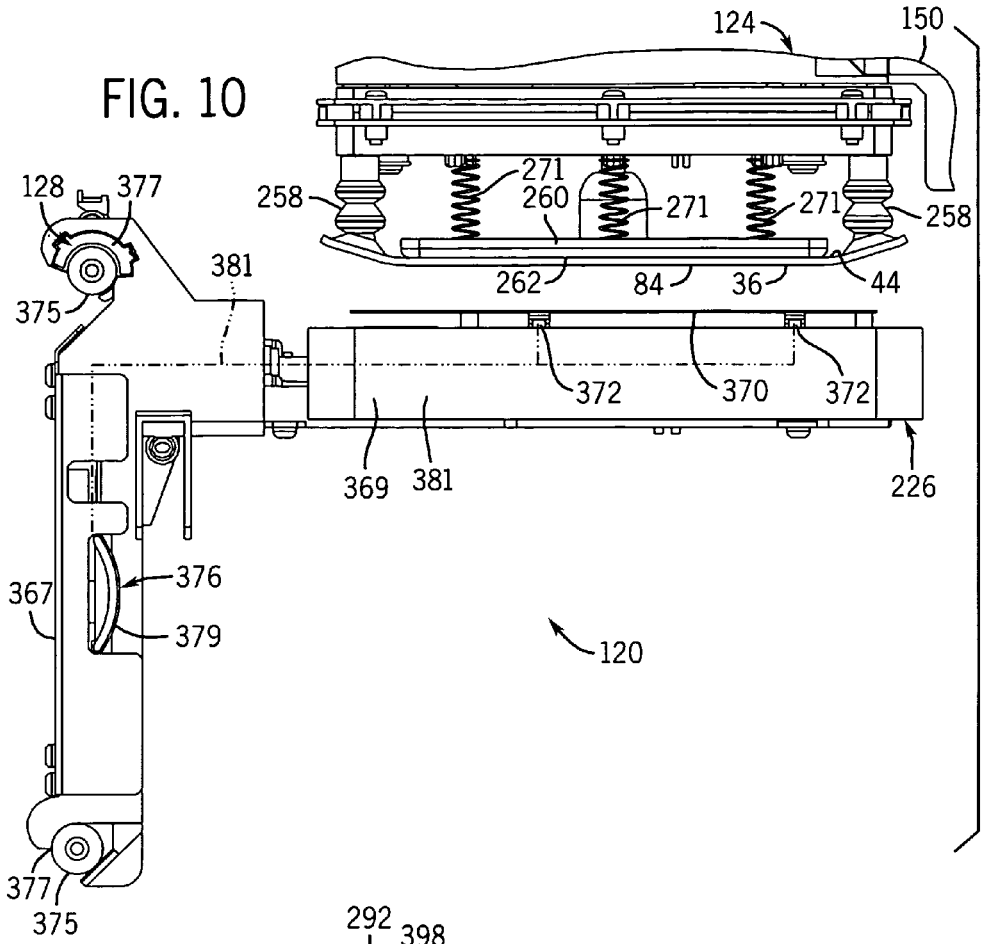
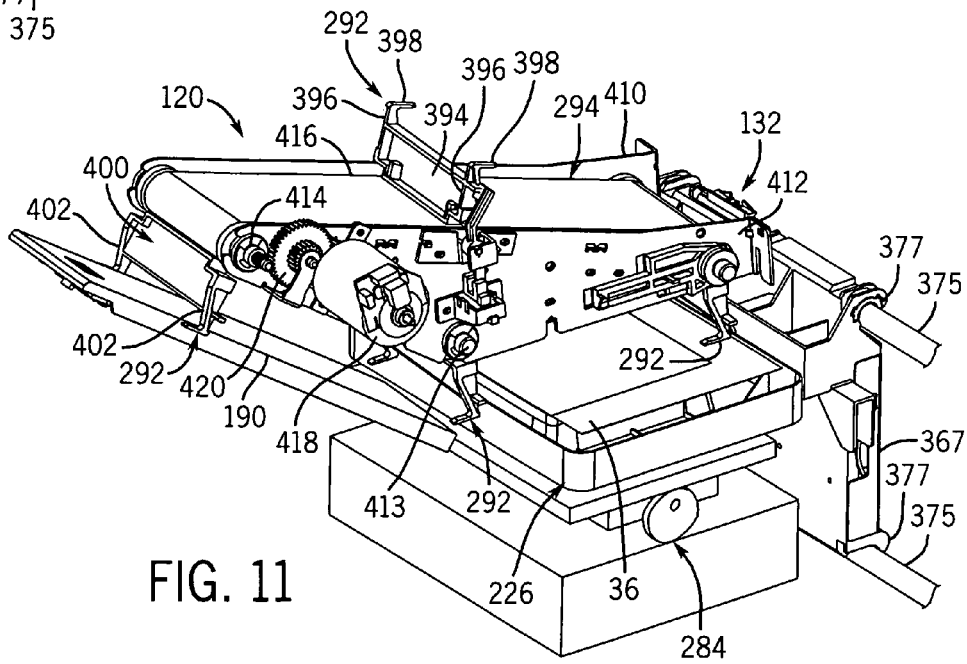
FIG. 11

SHEET HANDLING USING A RAMP AND GRIPPERS ON AN ENDLESS BELT

BACKGROUND

During handling of sheets of media, the sheets may become damaged or may cause jams within a device. In applications where printing is performed on the sheet, the printing itself may be scratched or damaged during the handling of the sheet within a device.

BRIEF DESCRIPTION OF THE DRAWINGS

FIG. 10 is a fragmentary side elevational view of the system of FIG. 2 illustrating a pick unit carrying a sheet and positioned above a shuttle tray according to one example embodiment.

FIG. 11 is a top perspective view of the shuttle tray positioned at an off-load station of the system of FIG. 2 according to one example embodiment.

DETAILED DESCRIPTION OF THE EXAMPLE EMBODIMENTS

Figure 1:
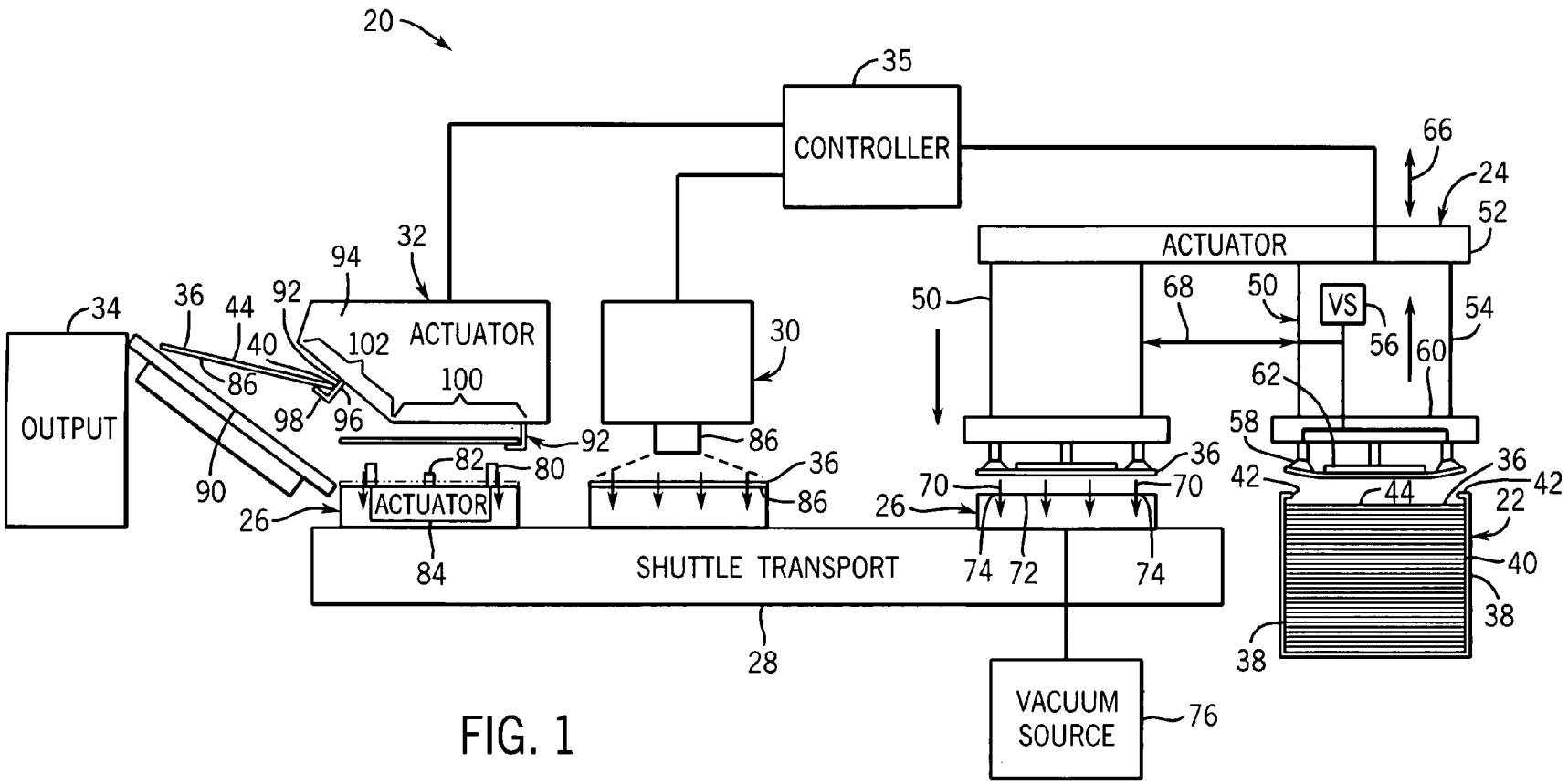
FIG. 1 is a schematic illustration of a sheet handling and interaction system according to one example embodiment.

FIG. 1 schematically illustrates sheet handling and interaction system 20 which is configured to handle sheets of media and to perform one or more processes upon the media such as depositing or printing fluid, such as ink, upon such media. Sheet handling and interaction system 20 generally includes sheet supply station 22, pick mechanism 24, shuttle tray 26 (shown at three positions), shuttle transport 28, print station 30, off-load station 32 and output 34. Sheet supply station 22 stores and supplies individual sheets 36 of media for an interaction system 20. Sheet supply station 22 includes one or more sidewalls 38 which engage edges 40 of sheets 36 to align sheets 36 such that sheets 36 are consistently positioned with respect to pick mechanism 24. Sheet supply station 22 additionally includes projections 42 which extend above a top face 44 and across the corners of the uppermost sheet 36 of the stack of sheets 36. In other embodiments, projections 42 may be omitted.

Pick mechanism 24 comprises a mechanism configured to pick the uppermost sheet 36 from sheet supply station 22 and to deposit the picked sheet 36 upon shuttle tray 26. Pick mechanism 24 includes pick unit 50 and actuator 52 (shown at two positions). Pick unit 50 picks or grasps the uppermost sheet 36 from sheet supply station 22 and generally includes body 54, vacuum source 56, vacuum cups 58 and pressure member 60. Body 54 is coupled to actuator 52 and generally houses and supports the remaining components of pick unit 50. Vacuum source 56 comprises a device configured to create a vacuum for each of vacuum cups 58. In one embodiment, vacuum source 56 comprises a blower carried by body 54 and in communication with cavities of vacuum cups 58. In other embodiments, other vacuum sources may be utilized.

Vacuum cups 58 generally comprise members extending from body 54 in communication with vacuum source 56 and configured to substantially seal against top face 44 of a sheet 36 while applying a vacuum to top face 44 so as to hold a sheet 36 against cups 58. Vacuum cups 58 are peripherally located about pressure member 60. In one embodiment, pick unit 50 includes four vacuum cups 58 configured to contact top face 44 of sheet 36 proximate to the four corners of sheet 36. In other embodiments, pick unit 50 may include a greater or fewer number of such vacuum cups at other locations.

Pressure member 60 comprises a member having a surface 62 supported by and movable relative to body 54 between an extended position in which surface 62 extends beyond cups 58 and a retracted position in which surface 62 is substantially even with or withdrawn relative to the terminal portions of cups 58. Pressure member 60 is further configured such that surface 62 is resiliently biased towards the extended position. In the example shown, surface 62 is centrally located between vacuum cups 58 so as to generally contact the central portion of face 44 of a sheet 36 of media when picking a sheet of media.

Actuator 52 generally comprises a mechanism configured to move pick unit 50. In the particular example shown, actuator 52 is configured to raise and lower pick unit 50 relative to sheet supply station 22 as indicated by arrows 66. Actuator 52 is also configured to move pick unit 50 in the direction indicated by arrows 68 between a position generally opposite to sheet supply station 22 and another position generally opposite to shuttle tray 26. Actuator 52 may comprise a hydraulic or pneumatic cylinder-piston assembly, an electric solenoid, a motor and a transmission including one or more belts, pulleys, gear assemblies or cams or other mechanisms to actuate or move pick unit 50.

In response to receiving control signals from controller 35, actuator 52 lowers pick unit 50 towards an uppermost sheet 36 at sheet supply station 22 while surface 62 is in the extended position. As a result, surface 62 will initially contact top face 44 of an uppermost sheet 36. Continued lowering of pick unit 50 by actuator 52 results in surface 62 being moved to the retracted position as vacuum cups 58 are brought into contact with face 44 of sheet 36. In response to receiving signals from controller 35, vacuum source 56 applies a vacuum through vacuum cups 58 such that the uppermost sheet 36 is grasped. Thereafter, actuator 52 lifts pick unit 50 which results in the held sheet 36 also being lifted. During such lifting, surface 62 resiliently returns to its extended position, resulting in the corners of sheet 36 gripped by the vacuum of vacuum cups 58 being upwardly bent or curved to peel the uppermost sheet 36 from underlying sheets 36 at sheet supply station 22.

As pick unit 50 is lifted, the corners of the uppermost sheet 36 grasped by pick unit 50 engage projections 42. Projections 42 temporarily bend or deform the corners of such sheets 36 in a downward direction as pick unit 50 is lifted. Once the corners of the grasped sheet 36 have been lifted beyond projections 42, the corners resiliently return to an upward orientation, creating a breaking away force between the grasped sheet 36 and any underlying sheet 36 which may be adhering to the grasped sheet 36.

Overall, the generally consistent positioning of sheets 36 by sheet supply station 22, the bending or arcing of a grasped sheet by vacuum cups 58 and pressure member 60 and the engagement of projections 42 with corners of the grasped sheet 36 facilitate separation of grasped sheet 36 from any underlying sheets to reduce the likelihood of multiple sheets being accidentally picked and to reduce the likelihood of resulting media jams within an interaction system 20. Once a sheet 36 has been picked by pick unit 50, actuator 52 moves pick unit 50 to a position opposite to shuttle tray 26 and vacuum source 56 either terminates the supply of vacuum or blows air through vacuum cups 58 to release the grasped sheet 36 and to deposit the sheet 36 upon tray 26.

Shuttle tray 26 comprises a member configured to support and hold a sheet 36 of media as the media is transported from pick unit 50 to print station 30 and to off-load station 32. As schematically indicated by arrows 70, shuttle tray 26 has a platform surface 72 including a plurality of vacuum ports 74 which are in communication with a vacuum source 76. Vacuum source 76 creates a vacuum through each of ports 74 to retain sheet 36 in place along surface 72. In particular embodiments, the vacuum applied through vacuum ports 74 may additionally be used to facilitate transfer of sheet 36 from pick unit 50.

As further shown by the shuttle tray 26 illustrated in a position opposite to off-load station 32, shuttle tray 26 additionally includes sheet lifters 80, 82 and actuator 84. Sheet lifters 80 and 82 comprise members carried by shuttle tray 26 and movable between a retracted position in which ends of lifters 80, 82 are level or recessed below platform surface 72 within tray 26 and an extended position in which ends of lifters 80, 82 project above platform surface 72 to lift the sheet 36 away from platform surface 72.

Actuator 84 comprises a mechanism to move sheet lifters 80, 82 between the retracted position and the extended position. In one embodiment, actuator 84 moves lifters 80, 82 to their extended positions, while allowing lifters 80, 82 to move to their retracted positions under the force of gravity. In other embodiments, actuator 84 moves lifters 80, 82 from the retracted positions to their extended positions and from their extended positions to their retracted positions. In one embodiment, actuator 84 is self contained within shuttle tray 26. In another embodiment, actuator 84 may additionally include components permanently located at off-load station 32. Actuator 32 may utilize pneumatic or hydraulic cylinder-piston assemblies, electric solenoids, motors and transmissions with belts, pulleys, cams and the like or other mechanisms configured to selectively move lifters 80, 82 between their extended and retracted positions.

In the particular example illustrated, lifters 80 extend above platform surface 72 by a distance different than that of lifter 82. As a result, the sheet of media is supported by lifters 80, 82 is in an arced or bent configuration. The bent configuration of the sheet 36 results in sheet 36 being stiffer to facilitate removal of sheet 36 from tray 26 at off-load station 32 as will be described in greater detail hereafter. In one embodiment, lifter 82 is centrally located so as to engage a center portion of sheet 36 while lifters 80 are peripherally located so as to engage peripheral portions of sheet 36. According to one example embodiment, shuttle tray 26 includes four lifters 80 configured to engage a bottom 86 of sheet 36 proximate to the corners of sheet 36. In their extended positions, lifters 80, 82 lift sheet 36 away from platform surface 72 to break the vacuum seal otherwise formed by vacuum ports 74. In other embodiments, shuttle tray 26 may include a greater or fewer number of lifters 80, 82 at different locations along platform surface 72 and movable between different heights relative to and movable between alternative heights relative to platform surface 72.

Shuttle transport 28 comprises a mechanism configured to move shuttle tray 26 between pick unit 50, print station 30 and off-load station 32. In one embodiment, shuttle transport 28 comprises an endless belt or chain coupled to shuttle transport 26 and configured to move shuttle transport 26 along the guides as a rod, bar or support surface. In another embodiment, shuttle transport 28 may comprise a motor and screw mechanism, a motor and rack and pinion mechanism, a hydraulic or pneumatic piston-cylinder assembly, an electric solenoid or other mechanisms configured to linearly translate shuttle tray 26.

Print station 30 comprises a station at which media 36 supported by shuttle tray 26 is interacted upon. In the embodiment shown, print station 30 is configured to deposit fluid, such as ink, upon top face 44 of sheet 36. In the example shown, fluid is deposited upon face 44 while sheet 36 is held by vacuum applied through vacuum ports 74 as indicated by arrows 70. In the particular embodiment illustrated, print station 30 includes a print device 86 configured to deposit fluid, such as ink, across substantially the entire face 44 during a single pass of shuttle tray 26 relative to print station 30. In another embodiment, print station 30 and print device 86 may alternatively be configured to be moved or scanned relative to surface 44 of sheet 36. In one embodiment, print device 86 comprises one or more inkjet printheads. In other embodiments, print device 86 may comprise other devices configured to deposit fluid upon face 44 or to otherwise form an image upon face 44 of sheet 36.

Off-load station 32 is configured to remove the printed upon sheet 36 from shuttle tray 26 and to transport the removed sheet to output 34. Off-load station 32 generally includes slide 90, trucks 92 and actuator 94. Slide 90 comprises a surface extending between platform surface 72 of shuttle tray 26 and output 34. In the particular example shown, slide 90 is inclined so as to form an upwardly extending ramp from shuttle tray 26 to output 34. As a result, output 34 may be positioned at a higher location to facilitate removal of printed upon sheets. In other embodiments, slide 90 may be supported at other orientations.

Trucks 92 comprise structures configured to engage and move a printed upon sheet 36 from shuttle tray 26 along slide 90 to output 34. Each truck 92 generally includes a leg 96 and a foot 98. Leg 96 extends from actuator 94 and is generally configured to engage or contact edge 40 of sheet 36. Foot 98 extends from leg 96 and is configured to extend along and contact a bottom face 86 of sheet 36. As a result, each truck 92 engages sheet 96 without substantially contacting printed upon face 44 to reduce the likelihood of smearing, scratching or otherwise damaging printed upon face 44 of sheet 36.

Trucks 92 are configured to move along a sheet removing path 100 and along a sheet transporting path 102. When moving along the sheet removing path 100, trucks 92 push sheet 36 in a generally horizontal direction across lifters 80, 82 onto slide 90. When moving along the sheet transporting path 102, trucks 92 push sheet 36 along slide 90 into output 34.

Actuator 94 comprises a device configured to move trucks 92 along the sheet removing path 100 and the sheet transporting path 102 in response to control signals from controller 35. In one embodiment, actuator 94 comprises an endless belt, chain or web coupled to each of trucks 92 and driven by a motor or other torque source to move trucks 92 along paths 100, 102. In other embodiments, actuator 94 may have other configurations and may utilize other sources such as hydraulic or pneumatic piston-cylinder assemblies, solenoids and the like to move trucks 92 along paths 100, 102.

Output 34 generally comprises a structure configured to receive and potentially store printed upon sheets 36 until retrieved. In one embodiment, output 34 may comprise a tray. In another embodiment, output 34 may comprise a bin.

Controller 35 generally comprises a processing unit configured to generate control signals which are communicated to pick mechanism 24, shuttle tray 26, shuttle transport 28, print station 30 and off-load station 32 to direct the operation of such devices or stations. For purposes of this disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 35 is not limited to any specific combination of hardware circuitry and software, nor to any particular source for the instructions executed by the processing unit.

According to one example embodiment, controller 35 generates control signals initially directing pick mechanism 24 to pick and deposit a sheet 36 upon shuttle tray 26 as described in detail above. Thereafter, controller 35 generates control signals directing vacuum source 76 to apply a vacuum through ports 74 to the sheet 36 placed upon shuttle tray 26 and directs shuttle transport 28 to transfer shuttle tray 26 to print station 30. Once shuttle transport 26 and the sheet 36 it carries are positioned opposite print station 30, controller 35 generates control signals directing print device 86 to deposit fluid, such as ink, upon face 44 of sheet 36 while vacuum source 76 continues to hold sheet 36 in place by applying a vacuum through ports 74. Upon completion of the deposition of fluid upon face 44 of sheet 36, controller 35 generates further control signals directing shuttle transport 28 to transfer shuttle tray 26 to off-load to a position opposite off-load station 32. Upon positioning of shuttle tray 26 at off-load station 32, controller 35 generates control signals directing actuator 84 to move lifters 80, 82 to their extended positions and to optionally cease or reduce the application of vacuum by vacuum source 76. Controller 35 further generates control signals directing actuator 94 to drive trucks 92 such that trucks 92 engage bottom 86 and edge 40 to move sheet 36 off of lifters 80, 82 and onto slide 90. In one embodiment, actuator 94 moves the off-loaded sheet 36 into output 34 without an interruption. In another embodiment, actuator 94 may temporarily pause with an off-loaded sheet 36 resting upon slide 90 while fluid or printing material dries or otherwise solidifies upon surface 44. After a predetermined period of time, actuator 94 continues operation to continue to drive trucks 92 to move the sheet 36 to output 34.

Figure 2:
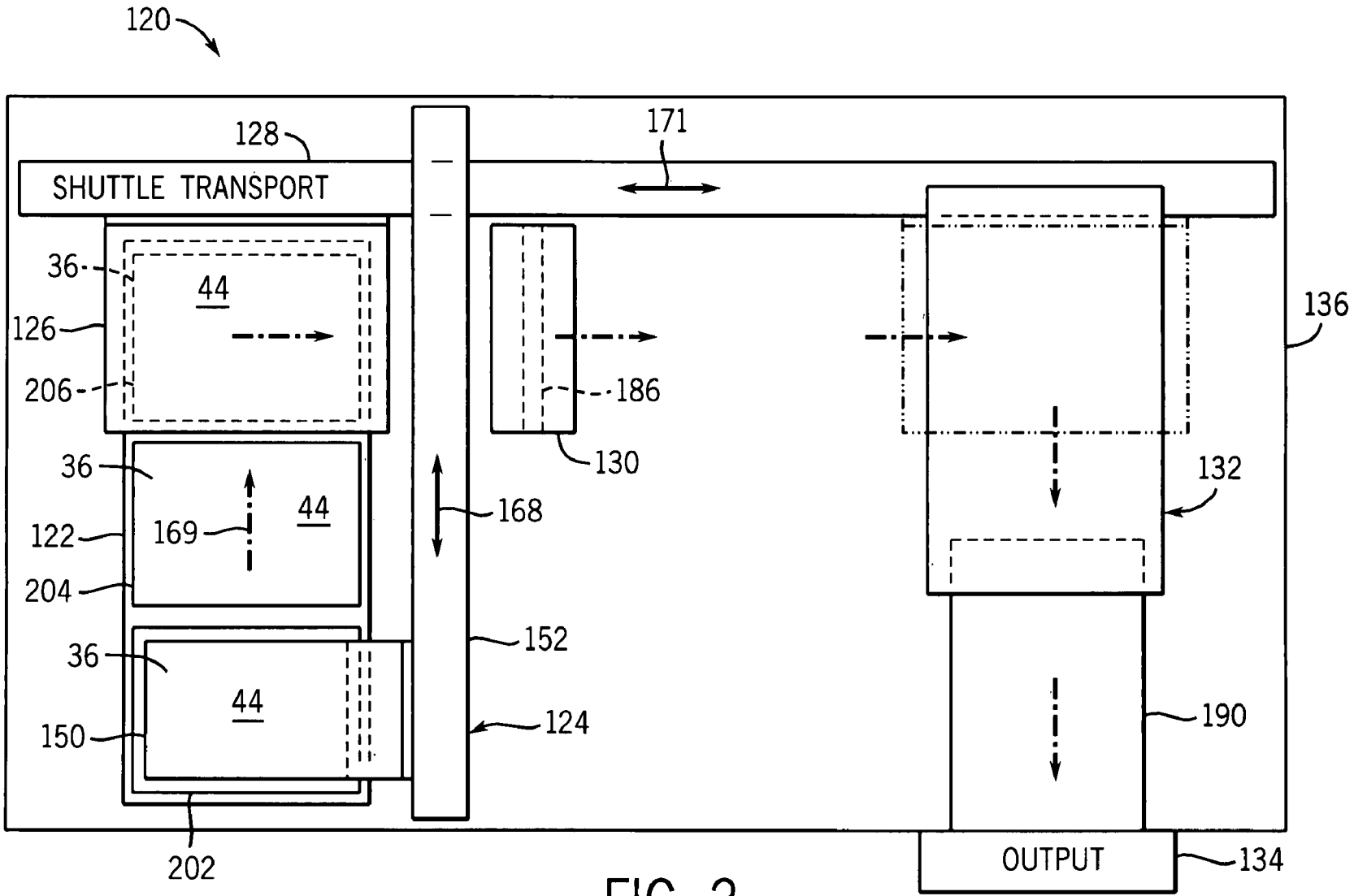
FIG. 2 is a top plan view schematically illustrating another embodiment of the sheet handling and interaction system of FIG. 1 according to one example embodiment.

FIGS. 2-16 illustrate sheet handling and interaction system 120, another embodiment of sheet handling and interaction system 20 shown in FIG. 1. FIG. 2 is a top view schematically illustrating an overall layout of sheet handling and interaction system 120. As shown by FIG. 2, sheet handling and interaction system 120 generally includes sheet supply station 122, pick mechanism 124, shuttle tray 126, shuttle transport 128, print station 130, off-load station 132 and output 134. In the particular example shown, each of sheet supply station 122, pick mechanism 124, shuttle tray 126, shuttle transport 128, print station 30, off-load station 132 and output 134 are housed, contained or otherwise supported by an overall housing or framework 136 which connects all of the components of sheet handling and interaction system 120 as a single unit such as a kiosk. In other embodiments, sheet handling and interaction system 120 may alternatively be provided by distinct sections mounted or positioned proximate to one another.

Sheet supply station 122 supplies sheets 36 of media for sheet handling and interaction system 120. Sheet supply station 122 includes individual magazines 202, 204 and 206 from which a sheet 36 may be picked by pick mechanism 124. Each magazine 202, 204, 206 is configured to contain a stack of sheets 36. In one embodiment, magazines 202, 204, 206 may be configured to contain differently sized sheets 36 or sheets 36 of different media. In another embodiment, magazines 202, 204 and 206 may be configured to supply sheets 36 having the same size and comprising the same media type.

Pick mechanism 124 is configured to selectively pick a sheet 36 from one of magazines 202, 204 and 206 and to deposit the sheet upon shuttle tray 126. Pick mechanism 124 includes pick unit 150 and pick actuator 152. Similar to pick unit 50, pick unit 150 is configured to grasp a topmost sheet 36. Pick actuator 152 is configured to move pick unit 150 and its grasped sheet 36 to a position above shuttle tray 126 and then to release or drop the sheet 136 onto shuttle tray 126. In the particular embodiment illustrated, pick actuator 152 is configured to move pick unit 150 along and over the top of each of magazines 202, 204 and 206 of sheet supply station 122 in the direction indicated by arrows 168. Once a sheet 36 is picked by pick unit 150, actuator 152 moves pick unit 50 and the grasped sheet 36 in the direction indicated by arrow 169 to a position over magazine 206.

Shuttle tray 126 is configured to support and hold a sheet 36 as the sheet 36 is moved to print station 130 and later to off-load station 132. In the particular example shown, shuttle tray 126 is movable to a position above magazine 206 of sheet supply station 122 and between magazine 206 and pick unit 150. As a result, a sheet 36 carried by pick unit 150 may be deposited upon shuttle tray 126 while pick unit 150 is positioned above both shuttle tray 126 and magazine 206. In a scenario where a sheet 136 is to be picked from magazine 206, shuttle tray 126 is initially moved out from above magazine 206, pick unit 150 then picks a sheet 136 from magazine 206 and shuttle tray 126 is then moved between magazine 206 and pick unit 150 for receiving the sheet 136. Because shuttle tray 126 is configured to receive a picked sheet 36 from pick unit 150 while shuttle tray 126 is over magazine 206, the overall architecture of sheet handling and interaction system 120 occupies less space and is more compact.

Shuttle transport 128 comprises a mechanism configured to move shuttle tray 126 in the direction indicated by arrows 171 between a position above magazine 206, a position generally opposite to printing station 130 and a position generally opposite to off-load station 132. As shown by FIG. 2, shuttle transport 128 moves shuttle tray 126 along an axis generally perpendicular to an axis along which pick unit 150 is moved and perpendicular to the arrangement of magazines 202, 204 and 206. As a result, the overall length of magazines 202, 204 and 206 is reduced and the shorter dimension or width of each sheet 136 passes beneath print station 130 or with a shorter scan length. In other embodiments, the arrangement between magazines 202, 204, 206, pick mechanism 124, shuttle tray 126 and shuttle transport 128 may have other configurations.

Print station 130 comprises a mechanism configured to deposit fluid, such as ink, upon face 44 of a sheet 36. In the particular example shown, print station 130 includes a print device 186 configured to substantially span an entire width of a sheet 36 to allow borderless printing. In other embodiments, print device 186 may extend less than a full width of sheet 36 or may include one or more printheads that are scanned or moved relative to a sheet 36 supported on a shuttle tray 126. Other suitable print stations may alternatively be employed.

Off-load station 132 is configured to extend above shuttle tray 126 when shuttle tray 126 is positioned at off-load station 132. Off-load station 132 engages a bottom and an edge of a sheet 36 supported upon shuttle tray 126 and moves the sheet 136 off of shuttle tray 126 onto slide 190 and into output 134 as will be described in greater detail hereafter.

In operation, controller 35 (shown in FIG. 1) generates control signals which are communicated to pick mechanism 124, shuttle tray 126, shuttle transport 128, print station 130 and off-load station 132. In response to signals from controller 35, pick actuator 152 positions pick unit 150 above one of magazines 202, 204, 206 and picks a sheet 36. Thereafter, the picked sheet 36 is moved in the direction indicated by arrow 169 until positioned over magazine 206 and over shuttle tray 126. The picked sheet 136 is deposited upon shuttle tray 126 and shuttle transport 128 moves shuttle tray 126 and sheet 36 relative to a position opposite to print station 130. In response to control signals from controller 35 (shown in FIG. 1), print station 130 prints upon surface 44 of sheet 36 and shuttle transport 128 moves shuttle tray 126 and the printed upon sheet 36 to a position opposite to off-load station 132. Off-load station 132 removes the printed upon sheet from shuttle tray 126 and into output 134 for storage until receipt.

Figure 3:
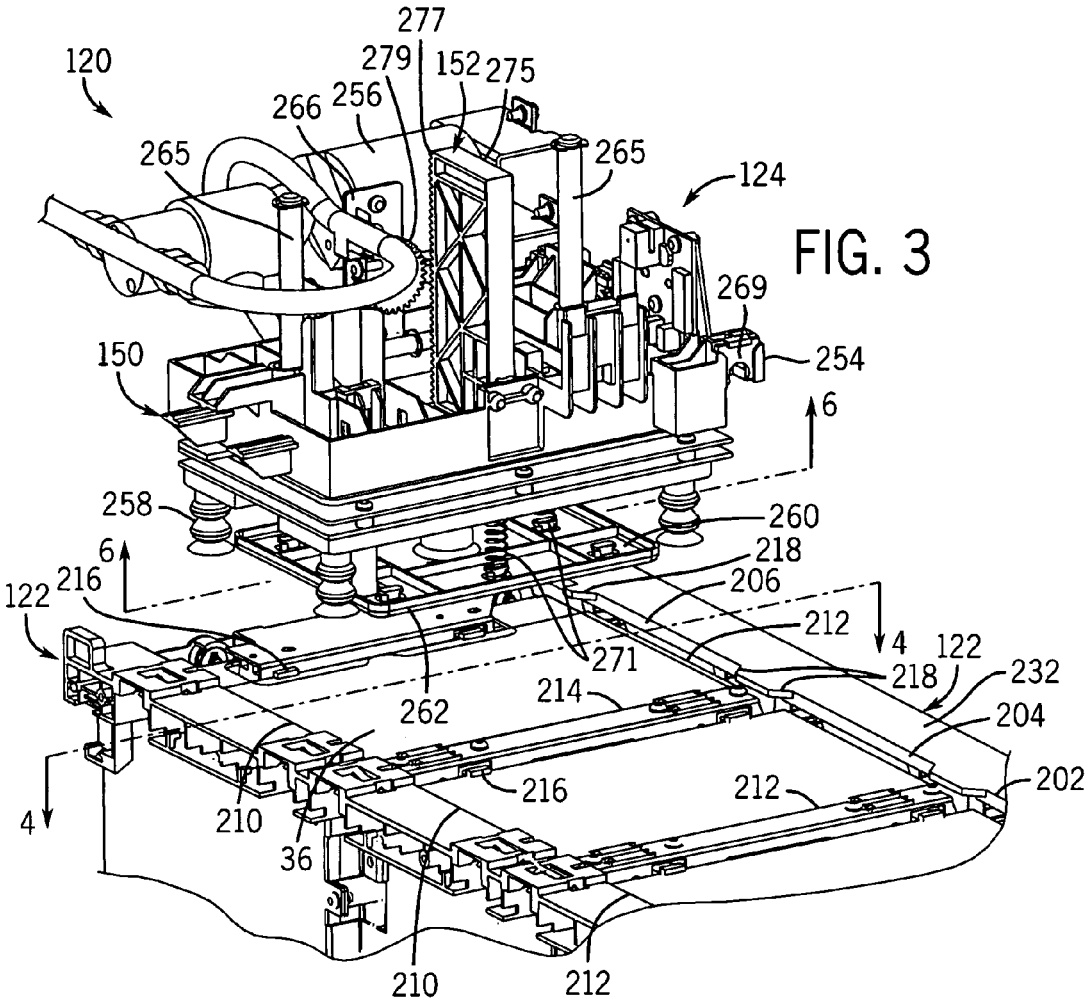
FIG. 3 is a fragmentary top perspective view of the system of FIG. 4 taken along line 5-5 according to one example embodiment.
Figure 5:
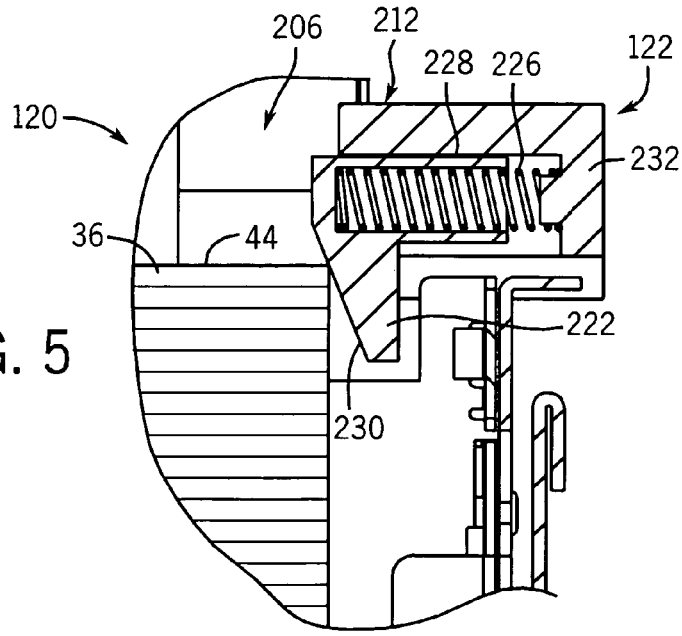
FIG. 5 is a fragmentary sectional view of the system of FIG. 4 taken along a lint 5-5 according to one example embodiment.
Figure 4:
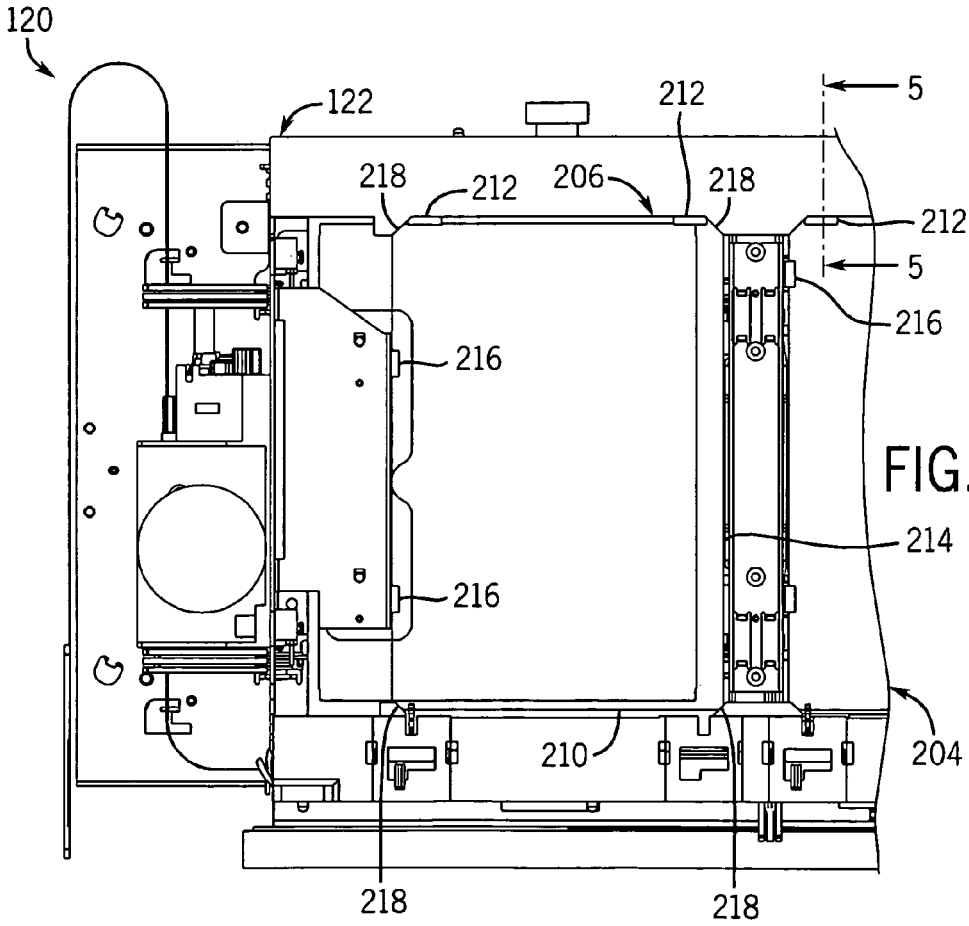
FIG. 4 is a fragmentary top plan view of the system of FIG. 3 taking along a line 4-4 according to one example embodiment.

FIGS. 3-5 illustrate details of an example embodiment of sheet supply station 122. As shown by FIGS. 3 and 4, each magazine 202, 204 and 206 of station 122 includes a short side datum wall 210, a short side media pusher 212, a long side datum wall 214, a long side datum pusher 216 and corner projections 218. Short side datum wall 210 provides a surface against which a short side or edge of each sheet 36 within the corresponding magazine 202, 204, 206 may be urged and aligned by short side media pusher 212. Short side media pusher 212 comprise one or more members spaced along a short side of the stack of sheets 36 and configured to resiliently bias and urge sheets 36 towards short side datum wall 210.

As shown by FIG. 5, short side sheet pusher 212 generally includes blade 222 and spring 226. Blade 222 is movably and slidably disposed within a guiding cavity 228 along the stack of sheets 36. Blade 22 includes a surface 230 configured to abut sheets 36 including the uppermost sheet 36. Spring 226 comprises a compression spring captured between blade 230 and an outer body 232 of the respective magazine 202, 204, 206. When sheets 36 are placed within the associated magazine 202, 204, 206, spring 226 is placed under compression. As a result, spring 226 resiliently biases blade 230 against sheet 36 to resiliently bias sheet 36 towards short side datum wall 210. As a result, uppermost sheet 36 is consistently positioned against short side datum wall 210.

Long side datum 214 extends along a long side of a stack of sheets 36 opposite to long side sheet pusher 216. Long side sheet pusher 216 is substantially identical to short side sheet pusher 212 except that pusher 216 extends opposite to datum wall 214 and resiliently biases and urges an uppermost sheet 36 towards and against long side datum wall 214. As a result, at least the uppermost sheet 36 is consistently positioned against long side datum wall 214. Because sheets 36 are repeatedly positioned against short side datum wall 210 and long side datum wall 214, picking of sheets 36 by pick mechanism 124 is more consistent.

Corner projections 218 generally comprise structures projecting from body 232 of sheet supply station 122 so as to extend above the corners of sheets 36. As shown in FIG. 4, in the particular example shown, each magazine 202, 204, 206 includes a projection 218 for each of the four corners of sheets 36. Projections 218 are spaced above the uppermost sheet 36 by a predetermined distance and project over the corners of the uppermost sheet by a predetermined distance to facilitate separation of the uppermost sheet 36 being picked by pick mechanism 124 and the next subjacent sheet 36. In the particular example illustrated, the lower surface of each projection 218 is spaced from the uppermost sheet 36 in each of magazines 202, 204 and 206 by a minimum distance of at least 2 mm and a maximum distance of 8 mm and nominally 5 mm. In the particular example shown, each projection 218 extends at an angle of about 45 degrees with respect to a long side of each sheet 36 and extends at least 2.5 mm, no greater than 4.5 mm and nominally about 3.5 mm from the short edge and the long edge of the uppermost sheet 36. In other embodiments, projections 218 may extend at other heights above the uppermost sheet 36, may extend at different angles with respect to the uppermost sheet 36 and may extend over the corners of sheet 36 by differing extents.

Figure 6:
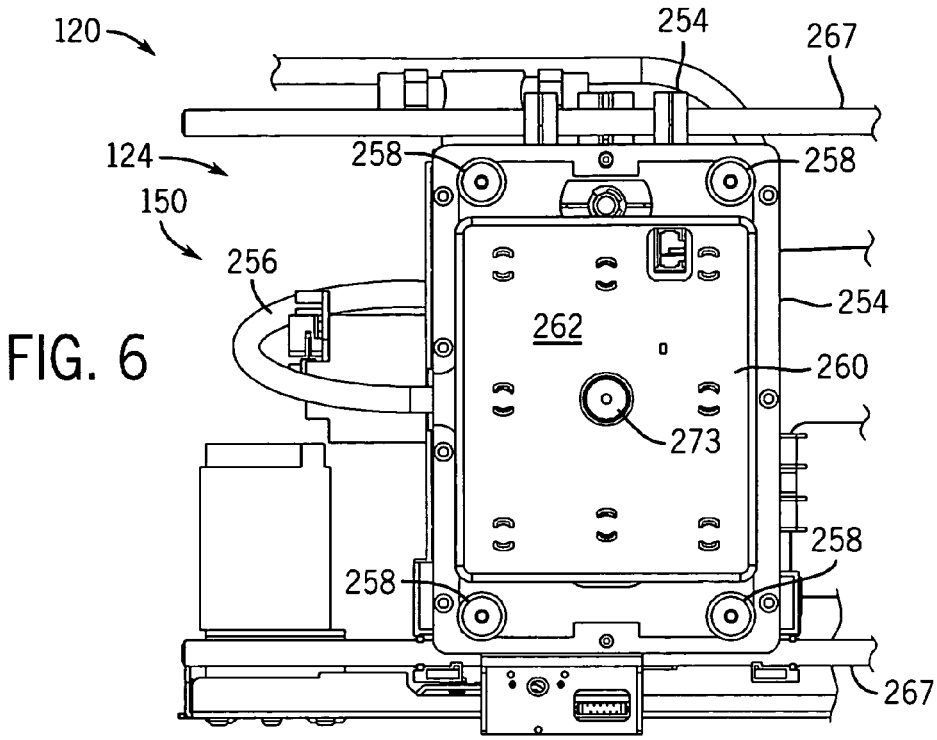
FIG. 6 is a fragmentary elevational view of the system of FIG. 3 taken along line 6-6 according to one example embodiment.

FIGS. 3 and 6 illustrate pick mechanism 124 in detail. As shown by FIGS. 3 and 6, pick unit 150 includes body 254, vacuum source 256, vacuum cups 258, pressure member 260 having pressure surface 262. Body 254 comprises a framework configured to movably support vacuum source 258, vacuum cups 258 and pressure member 260 for movement in vertical and horizontal directions. In the example shown, vertical guide shafts 265 coupled to a base framework of sheet handling and interaction system 120 guide vertical movement of body 254 and pick unit 150. In the particular embodiment illustrated, at least one horizontal guide shaft 267 (shown in FIG. 6) is slidably positioned within openings 269 and body 254 and slidably guide movement of body 254 in a substantially horizontal direction above magazines 202, 204 and 206. In other embodiments, body 254 may have other configurations for movably supporting the remainder of pick unit 150 in both vertical and horizontal directions.

Vacuum source 256 comprises a blower configured to draw air through vacuum cups 258. Vacuum cups 258 comprise bellows vacuum cups and are peripherally located about pressure member 260. In the particular example shown in FIG. 6, pick unit 150 includes four vacuum cups 258 configured to apply vacuum to and grasp top surface 44 of an uppermost sheet 36 proximate to the corners of the uppermost sheet 36. In the particular example illustrated in which pressure member 260 is substantially rectangular or square, vacuum cups 258 are arranged proximate to each corner of pressure member 260. In the particular example illustrated, vacuum source 256 and vacuum cups 258 are configured to create a vacuum of about 20" Mercury when picking a sheet 36. Other suitable pressure levels for the vacuum may be alternatively employed. In other embodiments, pick unit 150 may have a greater or fewer number of such vacuum cups, having the same or different configurations or having alternative locations with respect to pressure member 260.

Figure 7:
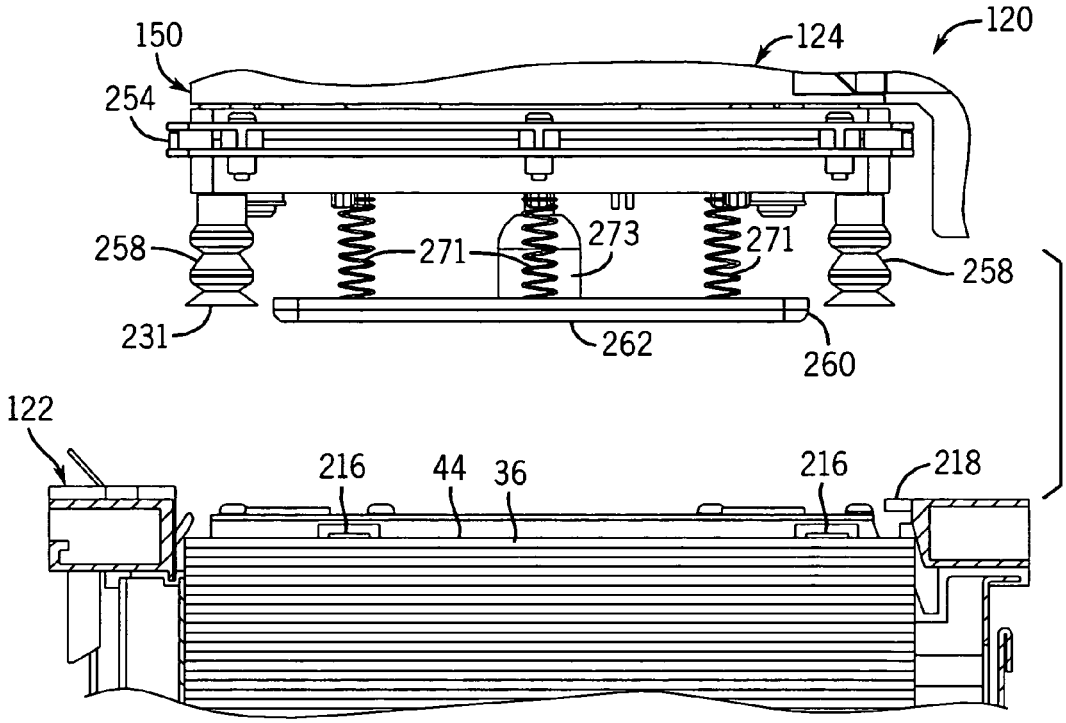
FIG. 7 is a fragmentary sectional view of the system of FIG. 3 illustrating a pick unit of a pick station elevated above a media supply station according to one example embodiment.
Figure 8:
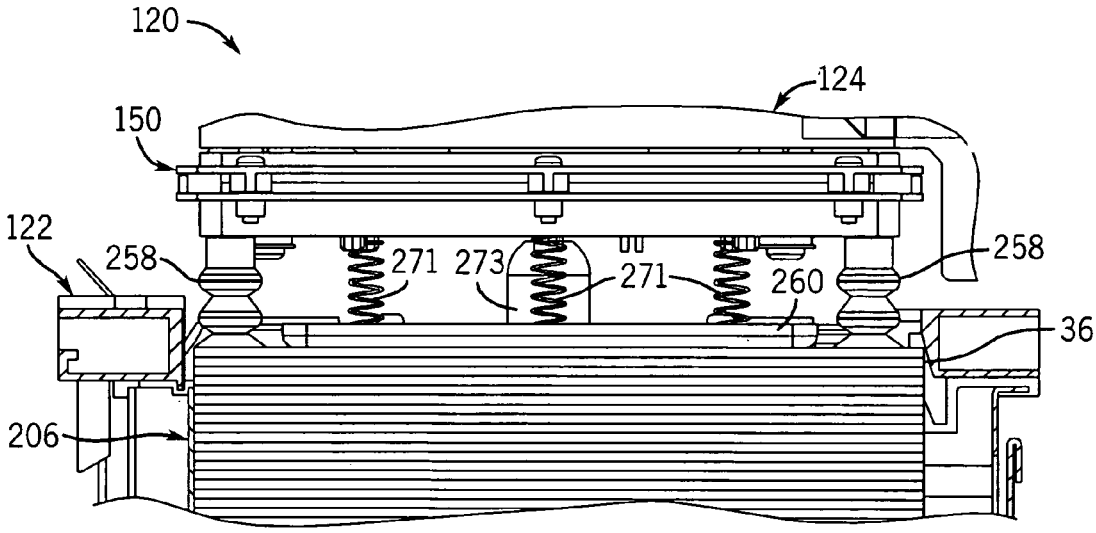
FIG. 8 illustrates the system of FIG. 7 with the pick unit lowered into engagement with media in the media supply station according to one example embodiment.

Pressure member 260 comprises a structure movably supported relative to body 254 between an extended position in which surface 262 extends beyond a terminus of vacuum cups 258 (as seen in FIGS. 3 and 7) and a retracted position in which surface 62 is equal or withdrawn relative to the terminus of vacuum cups 258 as seen in FIG. 8. As shown by FIG. 3, in the particular example illustrated, pressure member 260 is resiliently biased towards the extended position by compression springs 271. In other embodiments, other mechanisms may be used to resiliently bias pressure member 260 towards the extended position.

As shown by FIG. 6, in the particular example illustrated, pressure member 260 additionally includes a vacuum port 273 through which vacuum supplied by vacuum source 256 is applied to a sheet 36 being picked by pick unit 150. In the particular example illustrated, vacuum port 273 applies a vacuum of 20" Mercury. In other embodiments, vacuum port 273 may apply a greater or lesser vacuum. In still other embodiments, pressure member 260 may omit vacuum port 273. Although pressure plate 260 is illustrated as being generally rectangular; pressure member 260 may have other shapes and configurations.

As shown by FIG. 3, pick actuator 152 includes a vertical lift 275 including a rack gear 277 coupled to body 254 and a pinion gear 279 rotatably supported by a main frame 266 of sheet handling and interaction system 120 and operably coupled to a torque source, such as a motor and an encoder (not shown). Selective rotation of pinion gear 279 results in rack gear 275 and body 254 being selectively raised and lowered. Pick actuator 252 additionally includes a horizontal actuation component (not shown) coupled to main frame 266 and configured to slide body 254 along shaft 267 (shown in FIG. 6). In the particular example illustrated, the horizontal actuation component comprises a endless toothed belt and drive motor. In other embodiments, the horizontal actuation component of pick actuator 152 may comprise other mechanisms such as a hydraulic or pneumatic cylinder-piston assembly, an electric solenoid or a motor and transmission configured to convert rotational movement to linear movement.

FIGS. 6-8 illustrate picking of a sheet 36 of media from one of magazines 202, 204, 206 by pick unit 150 according to one example embodiment. FIG. 7 is a sectional view illustrating pick unit 150 positioned by pick actuator 124 above magazine 206 as shown in FIG. 3. As shown by FIG. 7, springs 271 resiliently bias pressure member 260 to its extended position such that surface 262 extends beyond a lower end 281 of vacuum cups 258.

FIG. 8 illustrates pick unit 150 after vertical drive 275 of pick actuator 124 (shown in FIG. 3) has been actuated to lower pick unit 50 to position vacuum cups 258 into contact with top face 44 of an uppermost sheet 36. In the lowered position shown, pressure member 260 is moved against the bias of springs 271 to compress springs 271 and to position pressure 260 in its retracted position. Vacuum is applied through vacuum cups 258 and through vacuum ports 273 to hold the uppermost sheet 36 against vacuum cups 258 and pressure member 260.

Figure 8A:
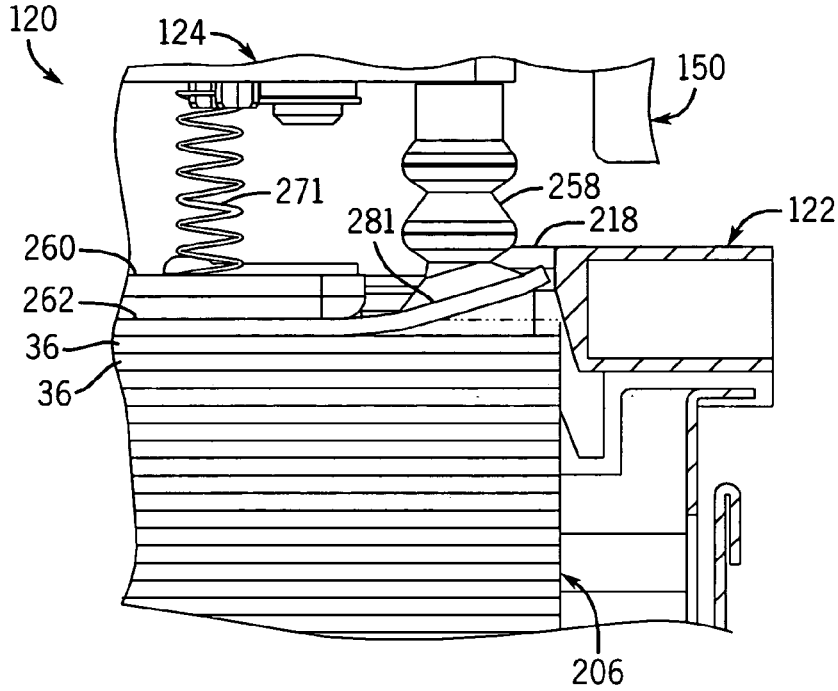
FIG. 8A is a fragmentary sectional view of the system of FIG. 3 illustrating initial lifting of the pick unit with a picked sheet according to one example embodiment.
Figure 9:
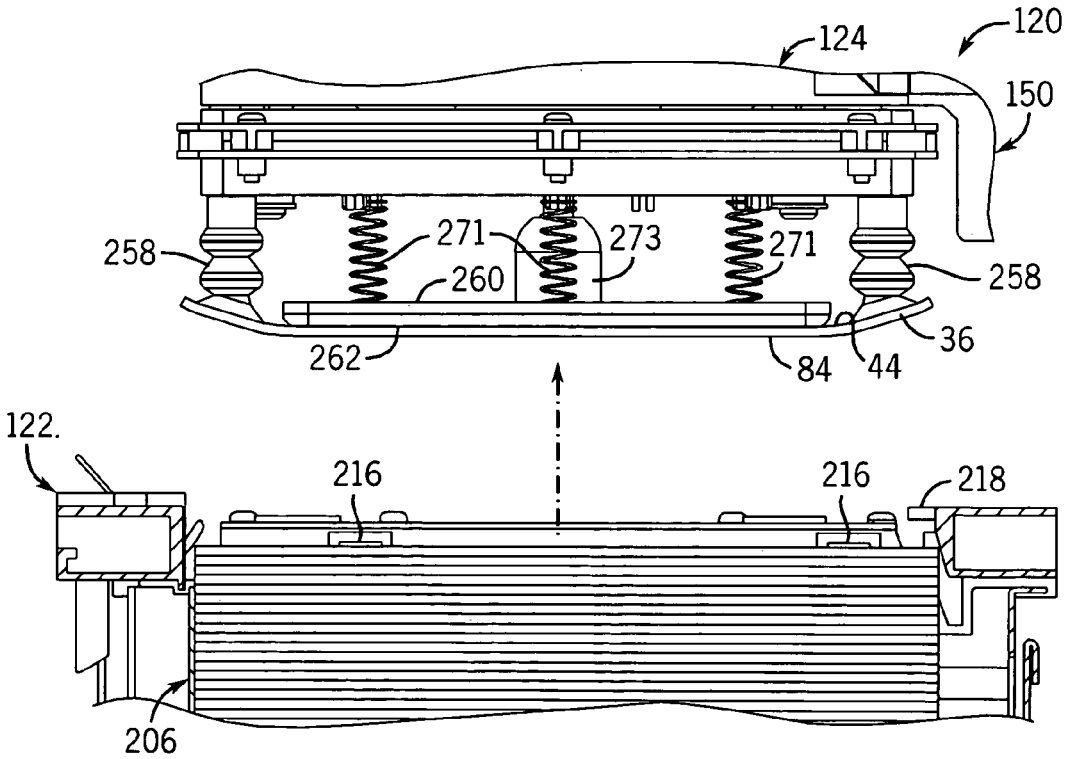
FIG. 9 is a fragmentary sectional view of the system of FIG. 3 illustrating lifting of a picked sheet from the media supply station by the pick unit according to one example embodiment.

FIG. 8A illustrates vertical lift 275 and pick actuator 152 (shown in FIG. 3) beginning to lift pick unit 150 and the held sheet 36. As shown by FIG. 8A, during initial lifting of pick unit 150, vacuum cups 258 rise and lift peripheral portions of sheet 36. At the same time, springs 271 decompress and resiliently return surface 262 of pressure member 260 to the extended position in which surface 262 extends beyond lower end 281 of vacuum cups 258. As a result, the central portion of the sheet 36 being picked is held lower than the peripheral portion of the sheet 36. The upward bending of the peripheral portions of sheet 36 peels sheet 36 away from the next subjacent sheet 36. During lifting of pick mechanism 252, the corners of the picked sheet 36 engage and are bent downward by corner projections 218, creating a break-away force between the pick sheet 36 and the next subjacent sheet 36. Consequently, the picked sheet 36, according to some embodiments, is reliably separated from the next subjacent sheet 36 to reduce the likelihood of media jams within sheet handling and interaction system 120. FIG. 9 illustrates the completion of picking of sheet 36 from the remaining stack of sheets 36 of magazine 206.

FIG. 10 illustrates an example embodiment of shuttle tray 126 in detail. FIG. 10 further illustrates pick unit 150 and a pick sheet 36 positioned above shuttle tray 126 by pick actuator 152 (shown in FIG. 3) according to an example embodiment. In the position shown in FIG. 10, shuttle transport 128 has moved shuttle tray 126 to a location above magazine 206 (shown in FIG. 2).

As shown by FIG. 10, shuttle tray 126 includes support 367 and platform 369 including platform surface 370 and vacuum ports 372. Support 367 comprises one or more structures configured to movably couple platform 369 to shuttle transport 128. In the particular example illustrated, shuttle transport 128 includes a pair of elongate guides 375 which guide movement of shuttle tray 126 between sheet supply station 122, print station 130 and off-load station 132 (shown in FIG. 2). Support 367 includes a pair of bearings 377 which at least partially surround shaft 375 and which slide along shafts 375 during movement of shuttle tray 126. In other embodiments, support 367 as well as shuttle transport 128 may have other configurations for movably supporting shuttle tray 126.

Platform 369 extends from support 367. In the particular example shown, platform 369 is cantilevered with respect to support 367. In other embodiments, platform 369 may be supported from support 367 in other fashions.

Platform surface 370 extends in a substantially horizontal orientation that includes vacuum ports 372. As schematically shown in FIG. 10, vacuum ports 372 are dispersed along surface 370 and are pneumatically connected to vacuum source 376 which includes a pneumatic conduit 379 coupled to support 367 and connected to internal pneumatic conduits 381 provided in or coupled to platform 369 generally below surface 370. Vacuum supplied through conduits 379 and 381 and through vacuum ports 372 along surface 370 draws picked sheet 36 from pick unit 150 to surface 370. The vacuum holds the sheet against surface 370 as shuttle tray 126 is moved. As a result, sheet 36 is reliably positioned with respect to shuttle tray 126 during printing at print station 130 (shown in FIG. 2) and during off-loading at off-load station 132 (shown in FIG. 2).

Figure 13:
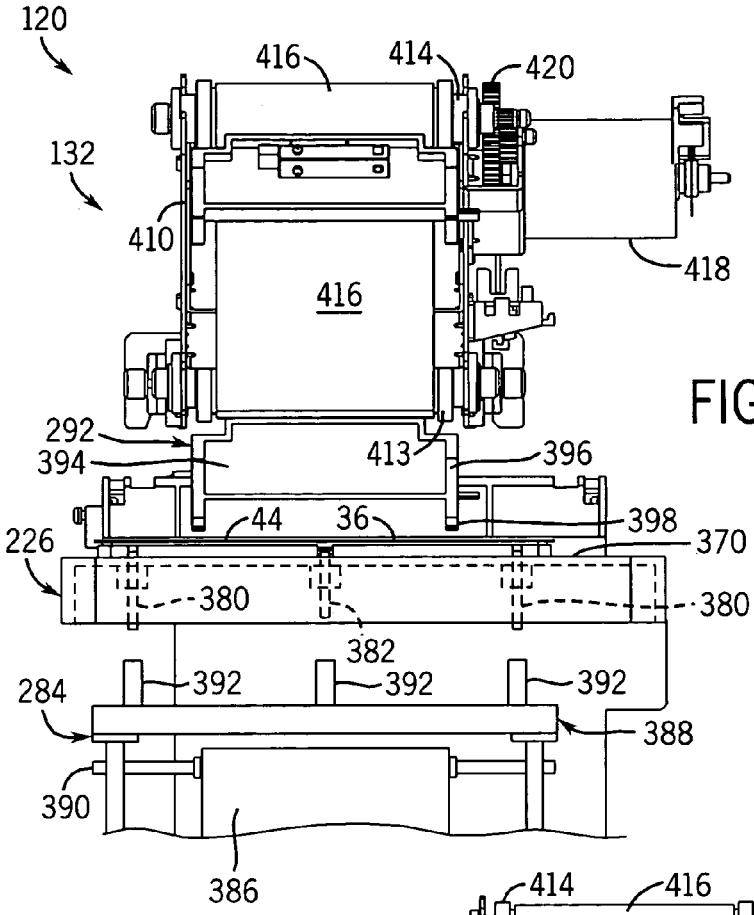
FIG. 13 is a fragmentary left side elevational view of the system of FIG. 11 according to one example embodiment.
Figure 15:
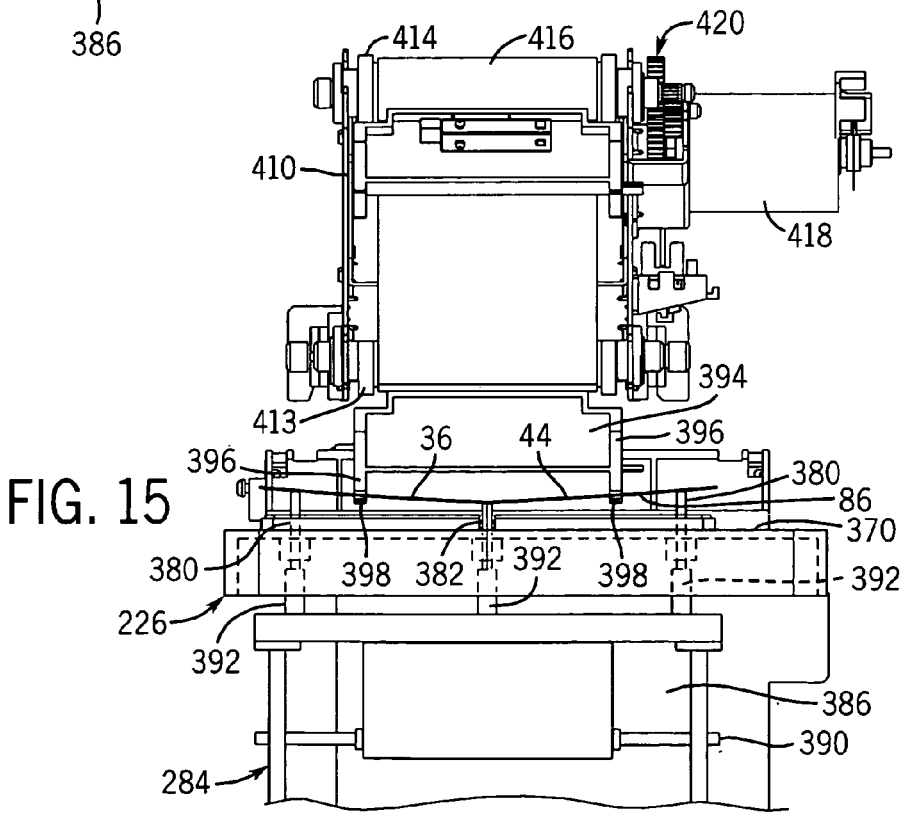
FIG. 15 is a fragmentary left side elevational view of the system of FIG. 14 according to one example embodiment.
Figure 16:
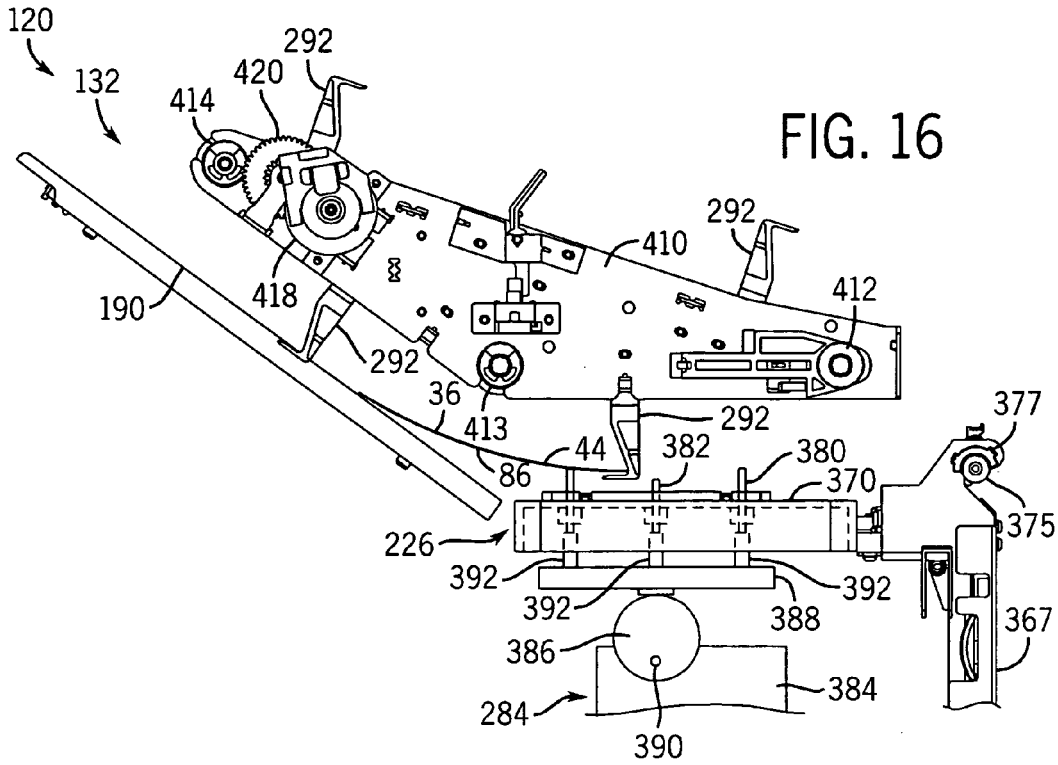
FIG. 16 is a fragmentary front elevational view of the system of FIG. 11 illustrating removal of the sheet from the shuttle tray according to one example embodiment.

As shown by FIGS. 13 and 15, shuttle tray 126 additionally includes lifters 380, 382. Lifters 380 comprise elongate members, such as pins, movably supported by platform 369 for movement between a retracted position shown in FIG. 13 and an extended position shown in FIG. 15. As shown in FIG. 15, when in the extended position, lifters 380, 382 elevate or lift sheet 36 above platform surface 372 to facilitate removal of sheet 36 at off-load station 132 (shown in FIG. 2). In particular embodiments where a vacuum is continuously applied through vacuum ports 372, lifting of sheet 36 of lifters 380, 382 additionally breaks the vacuum between platform 369 and sheet 36.

As shown by FIG. 15, when in their extended positions, lifters 380, 382 engage and support lower surface 86 of sheet 36 at different heights or spacings relative to platform surface 372. As a result, sheet 36 is supported in an arcuate or non-planar shape. In the particular example illustrated, lifters 380 have a different height or length as compared to lifter 382. In the embodiment shown, lifters 380 have a greater length as compared to lifter 382. In other embodiments, lifters 380, 382 may have common lengths, wherein lifters 380, 382 are moved by different distances when being actuated to their extended positions.

In the particular embodiment shown, lifters 380 are generally located peripheral to lifter 382 which is centrally located between lifters 380. In one embodiment, lifters 380 are uniformly spaced about lifter 382 and are located at proximate corners of platform 369. In other embodiments, lifters 380, 382 may have other arrangements and may be positioned at other locations. According to one example embodiment, lifters 380 project above platform surface 372 by at least 8 mm, less than or equal to 10 mm and nominally 9 mm. According to this example embodiment, lifter 382 projects above platform surface 370 less than or equal to 7 mm and nominally 6 mm when in the extended position. In some instances, lifter 382 is not raised above platform surface 370. According to one example embodiment, lifters 380 are linearly spaced from one another by about 75 millimeters on ends of platform surface 372 and about 127 millimeters along sides of platform surface 372. Lifter 382 is equi-distantly located between lifters 380.

Figure 12:
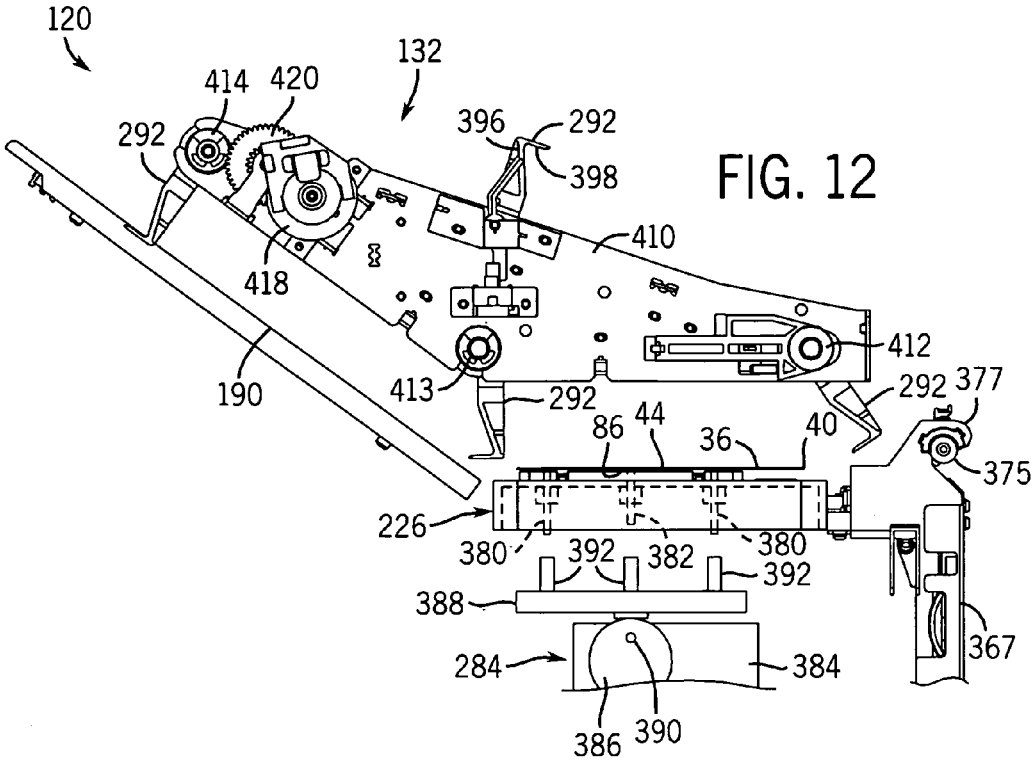
FIG. 12 is a fragmentary front elevational view of the system of FIG. 11 according to one example embodiment.

FIGS. 11-15 illustrate off-load station 132 in detail. As shown by FIG. 11, off-load station 132 generally includes lifter actuator 284, slide 290, trucks 292 and truck actuator 294. Lifter actuator 284 comprises a mechanism configured to actuate or move lifters 380, 382 from the retracted positions (shown in FIG. 13) to their extended positions (shown in FIG. 14). In the particular example illustrated, lifter actuator 284 is further configured to allow lifters 380, 382 to move from their extended positions to their retracted positions under the force of gravity. In other embodiments, lifter actuator 284 may alternatively be configured to move lifters 380, 382 to their retracted positions. As shown by FIG. 12, lifter actuator 284 includes rotary actuator 384, cam 386 and cam follower 388. Rotary actuator 384 comprises a mechanism configured to supply torque to and so as to rotate cam 386. In one particular embodiment, rotary actuator 384 may comprise an electric motor and a transmission coupled between the motor and cam 36 to transmit torque from the motor to cam 386. Examples of such a transmission may include a series of gears, a belt and pulley arrangement or a chain and sprocket arrangement.

Cam 386 comprises a circular or cylindrical cam configured to eccentrically rotate about axis 390 so as to raise and lower cam follower 388. Cam follower 388 comprises a structure in contact with cam 386. In response to rotation of cam 386, cam follower 388 moves between a lowered position (shown in FIG. 12) and a raised position (shown in FIG. 14). When cam follower 388 is in the raised position, cam 388 engages each of lifter 380, 382 to raise lifter 380, 382 to their extended positions. Although cam follower 380 is illustrated as including pillars 392 which engage a lower end of each of lifters 380, 382, cam follower 388 may alternatively include structures that engage more than one of lifters 380, 382 at any time. Although pillars 392 are illustrated as having substantially similar heights, pillars 392 may alternatively have differing heights to extend lifters 380, 382 to different extents.

Although lifter actuator 284 is illustrated as including a cylindrical cam and cam follower, rotary actuator 284 may alternatively comprise other mechanisms configured to engage and move lifters 380, 382 between their extended and retracted positions. For example, in another embodiment, lifter actuator 284 may comprise a hydraulic or pneumatic cylinder-piston assembly or an electric solenoid configured to raise and lower one or more lifters 380, 382. In still other embodiments, other actuation mechanisms may be employed.

Slide 190 generally comprises a surface supported and extending between shuttle tray 126 when shuttle 126 is at the off-load station 132 and output 134 (shown in FIG. 2). In the particular example illustrated, slide 190 is inclined so as to serve as a ramp along which printed upon sheets 32 are moved by trucks 292 to output 134 (shown in FIG. 2). In the particular example illustrated, slide 190 is inclined at an angle of at least 35°, less than or equal to 38 degrees and nominally 36.5 degrees with respect to shuttle tray horizontal. In other embodiments, slide 190 may be horizontal or may extend at other angles.

Trucks 292 generally comprise structures configured to engage an edge 40 and a bottom 38 for a printed upon sheet so as to transfer the printed upon sheet from shuttle tray 126, along slide 190 and to output 134. In the particular example illustrated, each truck 292 is coupled to truck actuator 294 and includes a mounting portion 394, legs 396 and feet 398. Mounting portion 394 secures truck 292 to truck actuator 294 and interconnects legs 396. Legs 396 generally extend from truck actuator 294 and terminate at feet 398. In the particular example illustrated, each of legs 396 includes a media engaging side 400 having a sloped shin 402 which is configured to engage edge 40 of printed upon sheet 36 and to retain edge 40 along shin 402. Feet 398 project from legs 396 on media engaging side 400. Feet 396 are configured to extend below and engage bottom 386 of the printed upon sheet 36. In other embodiments, trucks 292 may have other configurations.

Truck actuator 294 comprises a mechanism configured to move trucks 292 relative to shuttle tray 126 and slide 190. In the particular example shown, truck actuator 294 is configured to move trucks 292 along a sheet removing path 410 generally opposite to shuttle tray 126 and a sheet transporting path generally opposite and parallel to slide 190. In the particular example shown, truck actuator 294 includes frame 410, rollers 412, 414, belt 416, motor 418 and transmission 420. Frame 410 generally comprises a structure suspended above lifter actuator 284 and configured to support rollers 412, 414, belt 416, motor 418 and transmission 420. Roller 412 is rotatably supported by frame 410 at one end of belt 416 while roller 414 is rotatably supported by frame 410 at an opposite end of belt 416 which continuously extends about rollers 412 and 414. Belt 416 comprises an elongate continuous or endless flexible member coupled to each of trucks 292. In one embodiment, belt 416 is formed from urethane with reinforced fibers embedded in belt. In other embodiments, belt 416 may be formed from other flexible materials. Although trucks 292 are illustrated as being affixed to belt 416. In other embodiments, trucks 292 may be integrally formed as part of a single unitary body with belt 416.

Motor 14 is operably coupled to roller 414 by transmission 420. Transmission 420 comprises a series of gears configured to transmit torque produced by motor 418 to roller 414 to rotatably drive roller 414 and belt 416. Motor 418 generally operates in response to control signals from a controller, such as controller 35, shown in FIG. 1.

Figure 14:
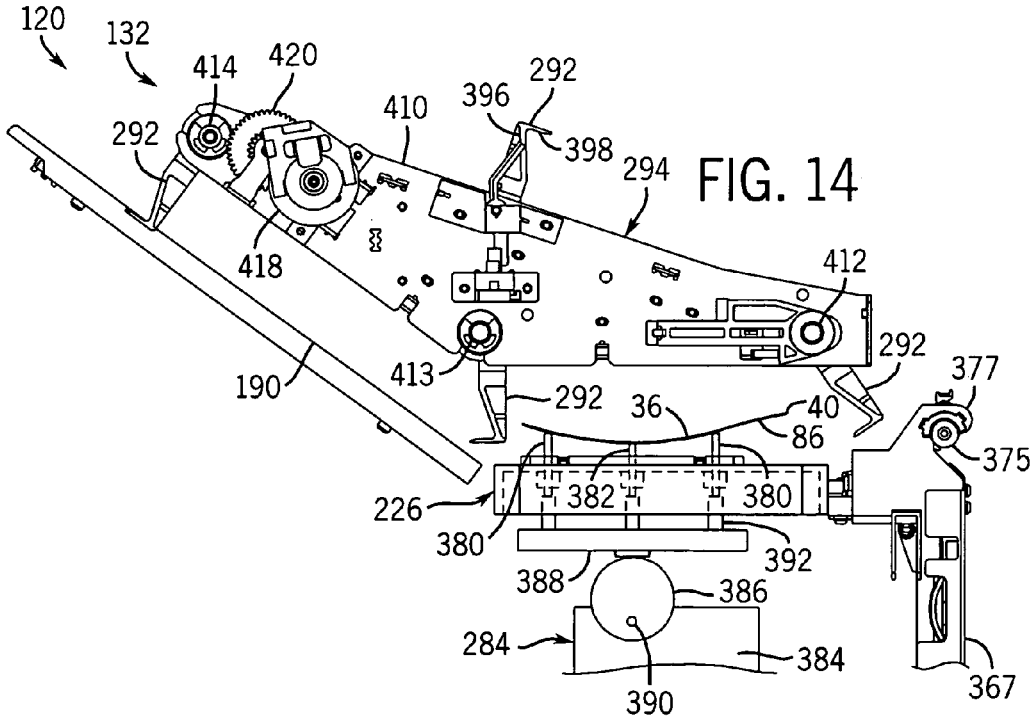
FIG. 14 is a front elevational view of the system of FIG. 11 illustrating lifting of a sheet above the shuttle tray according to one example embodiment.

FIGS. 11-15 illustrate unloading of a printed upon sheet at off-load station 132. As shown by FIGS. 11 and 13, shuttle tray 126 and the printed upon sheet 36 carried by shuttle tray 126 are initially positioned at output station 132 generally above lifter actuator 284 and below truck actuator 294. Once shuttle tray 126 is positioned at off-load station 132 as sensed by sensors (not shown) and communicated to a controller, such as controller 35, the controller generates and communicates control signals to rotary actuator 384 which drives cam 386 to lift cam follower 388 so as to move lifters 380, 382 to the extended position shown in FIGS. 12 and 14. As shown in FIGS. 12 and 14, lifters 380, 382, in their extended positions, raise sheet 36 from platform surface 370 and shape sheet 36 into an arc. As a result, sheet 36 is generally stiffer or more rigid when engaged along its edges by trucks 292.

As shown by FIG. 15, the controller further generates control signals which generates and communicates control signals to motor 418 which drives belt 416 about rollers 412, 413 and 414 to move trucks 292. In particular, legs 396 and feet 398 of one of trucks 292 are moved across platform surface 370 between or to a side of lifters 380, 382 while engaging edge 40 and bottom 86 of sheet 36. Motor 418 continues to drive belt 416 to move the particular truck 292 to move sheet 37 off of shuttle tray 126 and completely onto slide 190. In one embodiment, the controller generates control signals such that the movement of trucks 292 or movement of belt 416 and trucks 292 is temporarily paused while printed upon sheet 36 is wholly supported by slide 190 and the particular truck 292 engaging the sheet 36. During this pause, shuttle tray 126 is once again moved by shuttle transport 128 to sheet supply station 122 for receiving an unprinted upon sheet 36 and the process is once again repeated. During repeat of the process, the printed upon sheet 36 resting upon slide 190 is permitted to complete any further drying. Removal of the succeeding sheet 36 from shuttle tray 126 results in the previously removed sheet 36 being moved further along slide 190 and eventually to output 134. In other embodiments, the controller may be configured to generate control signals directing motor 418 to drive belt 416 and trucks 292 until a sheet removed from shuttle tray 126 is moved completely to output 34.

FIGS. 17-20 illustrate sheet handling and interaction system 420, another embodiment of sheet handling and interaction system 120 shown in FIGS. 2-16. Sheet handling and interaction system 420 is substantially identical to sheet handling and interaction system 120 except that sheet handling and interaction system 420 includes shuttle tray 426 and off-load station 432 in lieu of shuttle tray 126 and off-load station 132, respectively. Off-load 432 is substantially similar to off-load station 132 except that off-load station 432 omits lifter actuator 284. Shuttle tray 426 is similar to shuttle tray 126 except that shuttle tray 426 includes lifters 480 in lieu of lifters 180, 182 and additionally includes lift actuator 484. Those remaining elements of shuttle 426 which correspond to elements of shuttle tray 126 are numbered similarly.

Figure 17:
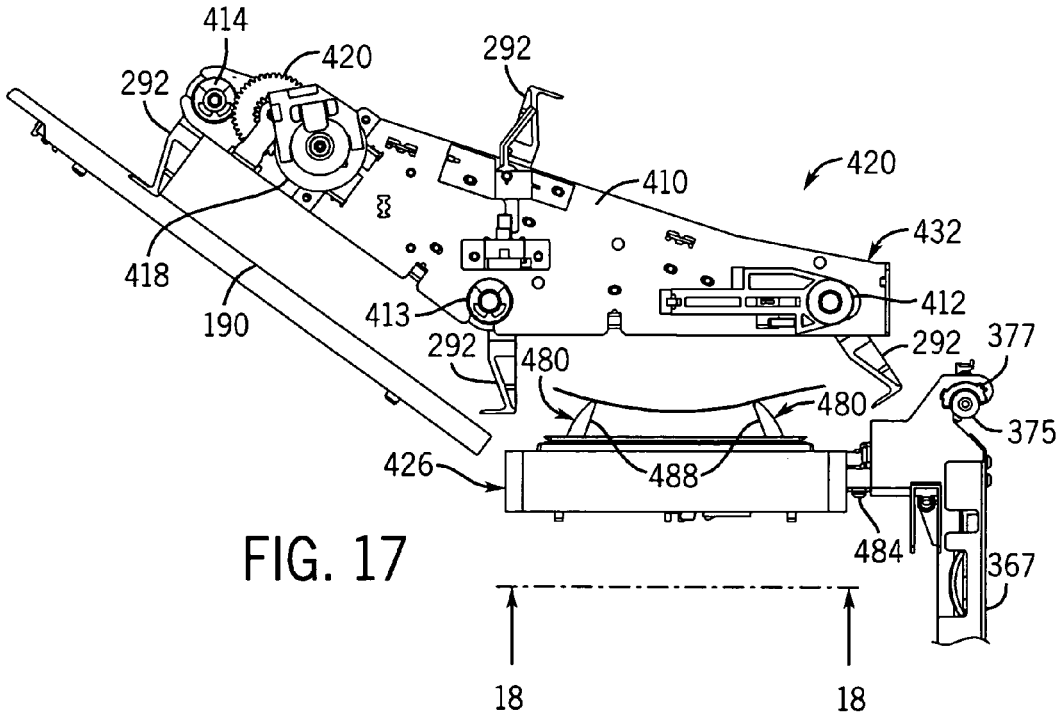
FIG. 17, is a fragmentary front elevational view of another embodiment of the printing system of FIG. 14 according to one example embodiment.
Figure 18:
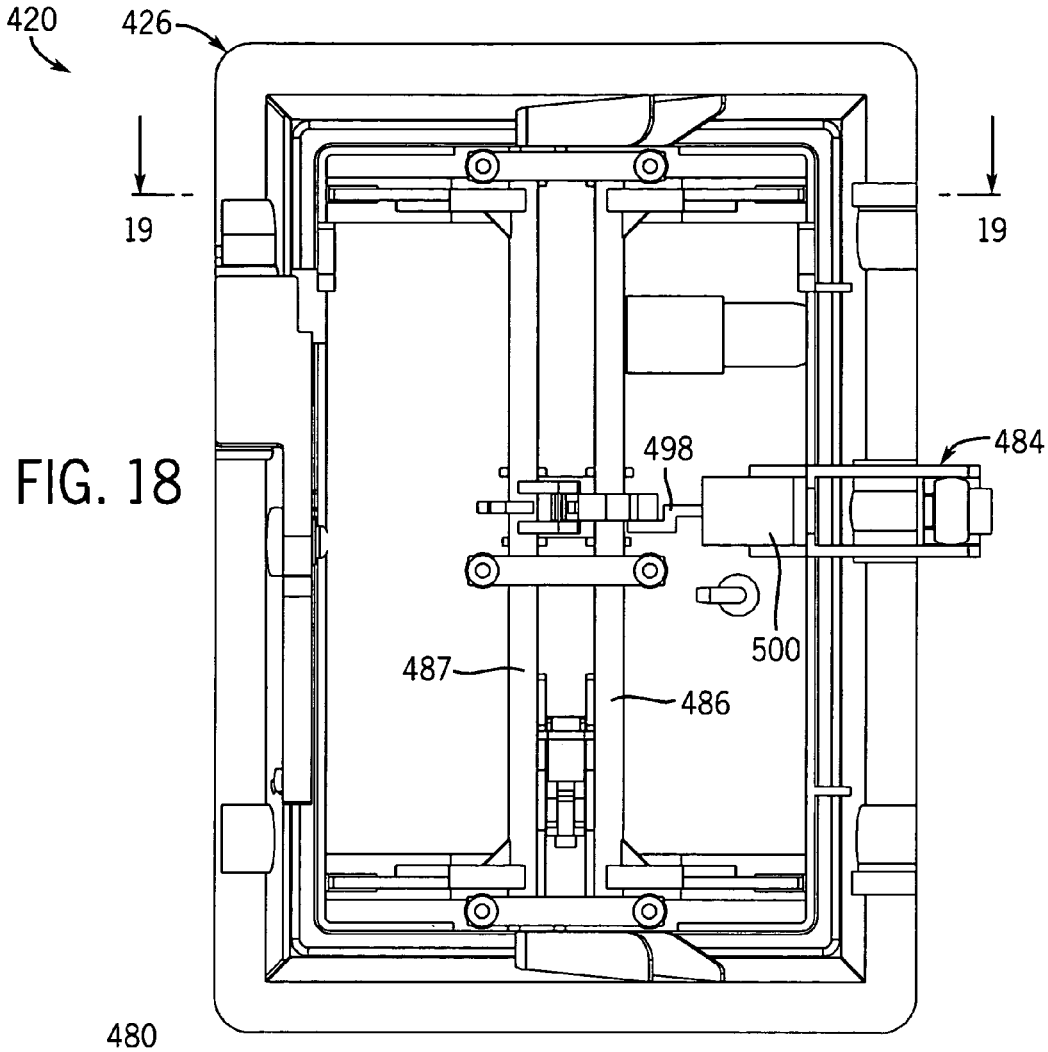
FIG. 18 is a bottom plan view of the printing system of FIG. 17 taken along line 18-18 according to one example embodiment.
Figure 19:
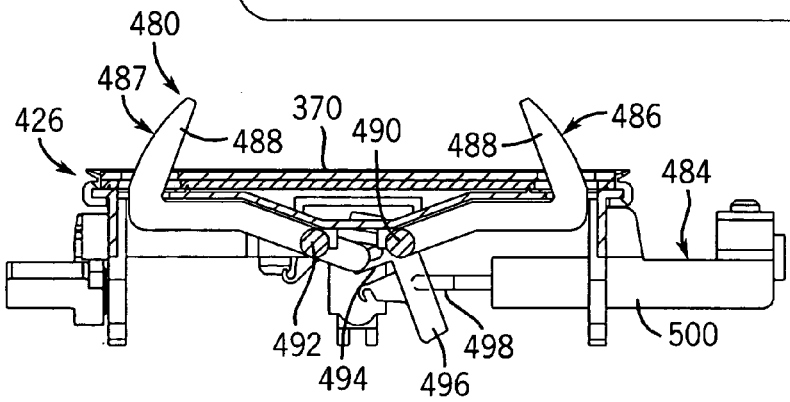
FIG. 19 is a sectional view of the system of FIG. 18 taken along line 19-19 illustrating lifters in an extended position according to one example embodiment.
Figure 20:
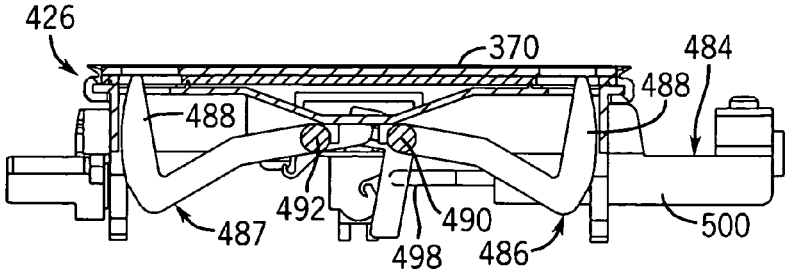
FIG. 20 is a sectional view of the system of FIG. 18 taken along line 19-19 illustrating lifters in a retracted position according to one example embodiment.

FIGS. 17-20 illustrate lifters 480 and lifter actuator 484 in detail. As shown by FIGS. 17-20, in the particular embodiment illustrated, lifters 480 comprise scissor arms 486, 487. Each scissor arm 486, 487 includes a terminal upwardly projecting or extending claw portion 488 which projects above platform surface 370 when lifters 480 are in their extended position as shown in FIGS. 17 and 19 and which are retracted or recessed below platform surface 370 when lifters 480 are in their retracted position as shown in FIG. 20. As shown by FIG. 19, scissor arms 486 and 487 are pivotally supported about axes 490 and 492, respectively. Scissor arm 486 additionally includes a slotted portion 494 which slidably receives a projecting portion (not shown) of scissor arm 488, and a lever portion 496 projecting away from axis 490. Slotted portion 494 interconnects lever arms 486 and 487 such that pivoting of scissor arm 486 about axis 490 also results in pivoting of scissor arm 487 about axis 492 in opposite directions. For example, pivoting of lever arm 486 in a counterclockwise direction about axis 490 to the position shown in FIG. 19 also results in lever arm 487 pivoting in a clockwise direction about axis 492 to the extended position shown in FIG. 19. Lever portion 496 provides a lever arm for interaction with lifter actuator 484 to pivot scissor arm 486 about axis 490.

Lever actuator 484 comprises a mechanism configured to engage lever portion 496 so as to pivot scissor arm 486 about axis 490. Lifter actuator 484 is coupled to and carried by shuttle tray 426. In the particular example shown, lifter actuator 484 comprises an engagement member 498 which is linearly moved relative to lever arm 486 by linear actuator 500. In one particular embodiment, engagement member 498 is fixedly coupled to lever portion 496. In another embodiment, engagement member 498 abuts lever arm 496.

Linear actuator 500 linearly moves engagement member 498 between an extended position shown in FIG. 19 in which claws 488 project above platform surface 370 to lift a sheet 36 as shown in FIG. 19 and a retracted position in which claws 488 are withdrawn below platform surface 370 as shown in FIG. 20. In one example embodiment, linear actuator 500 comprises an electric solenoid. In another embodiment, linear actuator 500 may comprise a hydraulic or pneumatic piston-cylinder assembly. In still other embodiments, linear actuator 400 as well as scissor arms 486, 487 may have other configurations. For example, although scissor arms 486, 487 are each illustrated as including a pair of claws 488, scissor arms 486, 487 may alternatively each include a greater or fewer number of such claws 488. Although claws 488 of scissor arms 486, 487 are illustrated as projecting above platform surface 370 by substantially the same distance when extended, scissor arms 486, 487 may alternatively be configured to extend claws 488 at different heights relative to platform surface 370.

Overall, systems 20, 120 and 420 are configured to handle sheets of print media in a reliable and consistent fashion, reducing or minimizing the potential for malfunctions and media jams. Because pick unit 50 and pick unit 150 bend pick sheet 36 to peel a pick sheet 36 from a subjacent sheet 36, because datum pushers 212 and 216 facilitate consistent positioning of a sheet 36 prior to being picked and because corner projections 42, 218 engage corners of a sheet 36 being picked and lifted to create a breaking away force, the likelihood of multiple sheets sticking together and being accidentally picked at pick stations 24 and 124 is reduced. Because shuttle tray 26, 126, 426 applies a vacuum to the picked sheet to hold the picked sheet 36 in place, a sheet 36 is reliably positioned on tray 26 during transport, during printing or other sheet interaction and during off-loading. Because trucks 92, 292 engage the bottom and side edges of a printed upon sheet without substantially contacting a top printed upon face 44 of a sheet 36, printed upon face 44 is less likely to become smudged, scratched or otherwise damaged during off-loading. Consistent off-loading of sheet 36 from shuttle tray 26, 126, 426 is further enhanced by sheet 36 being lifted by lifters 80, 82, 380, 382 or 480. Removal of the printed upon sheet 36 from shuttle tray 26 is further enhanced by the arcuate bending of the printed upon sheet 36 by such lifters. In the embodiment depicted in FIG. 2, because shuttle tray 126 is moved to a position over shuttle supply station 122 where shuttle tray 126 receives the picked sheet, printing and interaction system 120 is more compact.

The compact nature and reliable handling of sheets 36 by print systems 20, 120 and 420 facilitate the use of such systems as part of self-contained photo kiosks for printing personal photos at public gathering places such as malls, retail stores and the like. In other embodiments, print systems 20, 120 and 220 may also be incorporated as part of other devices configured to print upon individual sheets or other devices configured to interact with individual sheets in other matters such as scanning and the like. In such other embodiments where other interactions are to be made with individual sheets 36, print stations 30 and 130 may be omitted and may be replaced with other interaction mechanisms. Although systems 20, 120 and 420 are illustrated as combining multiple features such as the configuration of pick units 50, 150, shuttle trays 26, 126, 426 and off-load station 32, 132 and 432, systems 20, 120 and 420 may alternatively include fewer than all of such configurations or may have particular stations with different configurations.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A method comprising:

applying a vacuum to a sheet to retain the sheet against a surface;

elevating and arcing the sheet to break the vacuum; and engaging a bottom and an edge of the sheet while an entirety of the sheet is elevated and while moving the sheet.

2. The method of claim 1, wherein the bottom and of the edge of the sheet are concurrently contacted by a foot during movement of the sheet while the entirety of the is elevated.

3. An apparatus comprising:

a tray having a surface configured to support a sheet, wherein the tray is movable between a print zone and an off-loading station;

a vacuum port along the surface; and members movable through at least one opening in the surface between a first position at or recessed relative to the surface and a second position beyond the surface, wherein a first portion of the members project a first distance beyond the surface in the second position and wherein a second portion of the members project a second distance greater than the first distance beyond the surface in the second position to arc the sheet engaged by the members.

4. The apparatus of claim 3, further comprising a foot configured to extend between the surface and terminal ends of the members engage the bottom of the sheet.

5. The apparatus of claim 3 further comprising:

an actuator configured to move the members from the first position to the second position; and a controller configured to generate control signals directing the actuator to move the members from the first position to a second position so as lift an entirety of the sheet off the surface when in the second position.

6. The apparatus of claim 3, wherein the tray is configured to support the sheet when the sheet is being printed upon in the print zone.

7. An apparatus comprising:

a tray adapted to support a sheet, wherein the tray is movable between a print zone and an off-loading station;

an endless member movable about a plurality of axes; and a plurality of feet carried by the endless member and spaced along the endless member in a direction of travel of the of the endless member, the plurality of feet comprising:

a first foot configured to engage a bottom and an edge of a sheet and to move the sheet off the tray; and a second foot spaced from the first foot and configured to engaged the bottom and the edge of the sheet concurrently with the first foot.

8. An apparatus comprising:

a tray adapted to support a sheet, wherein the tray is movable between a print zone and an off-loading station;

at least one member movable through at least one opening in the tray between a first position at or recessed from a top surface of the tray and a second position beyond the top surface; and a plurality of feet spaced along an endless member and carried by the endless member movable about a plurality of axes, each of the plurality of feet being configured to engage a bottom and an edge of a sheet while the at least one members is in the second position to move the sheet of the tray.

9. The apparatus of claim 8, further comprising:

an output; and a ramp between the tray and the output, wherein each of the plurality of feet is configured to push an engaged sheet up the ramp the output.

10. An apparatus comprising:

a tray adapted to support a sheet, the tray including a top surface having a vacuum port, wherein the tray is movable between a print zone and an off-loading station;

at least one member movable through at least one opening in the tray between a first position at or recessed from the top surface of the tray and second position beyond the top surface;

an output;

an endless member movable about a plurality of axes and carrying a plurality of feet;

a ramp between the tray and the output, wherein the plurality of feet are configured to push the sheet up the ramp to the output;

wherein the endless member extends parallel to and along the ramp;

wherein the plurality of feet being carried by the endless member are spaced along the endless member in a direction of travel of the endless member, and wherein each of the plurality of feet is configured to contact a bottom and an edge of a sheet and move the off of the tray.

11. The apparatus of claim 10 further comprising a plurality of members movable between a first position at or recessed relative to the top surface and a second position beyond the surface.

12. The apparatus of claim 11 further comprising a platform opposite the tray when the tray is in an off-load position, wherein the platform is movable from a lower position to a raised position to move the members from the first position to the second position.

13. The apparatus of claim 11, wherein a first portion of the plurality of members project a first distance beyond the surface in the second position and wherein a second portion of the plurality of members project a second distance greater than the first distance beyond the surface in the second position to arc the sheet engaged by the numbers.

14. The apparatus of claim 11, wherein the plurality of feet include a first foot configured to extend between the top surface and terminal ends of the plurality of members when engaging the bottom of the sheet.

15. The apparatus of claim 14 further comprising a second foot transversely spaced from the first foot and configured to engage the bottom and the edge of the same sheet concurrently being engaged with the first foot.

16. The apparatus of claim 10, wherein the tray is configured to support the sheet when the sheet is being printed upon in the print zone.

* * * * *

UNITED STATES PATENT AND TRADEMARK OFFICE

CERTIFICATE OF CORRECTION

PATENT NO. : 7,597,319 B2
APPLICATION NO. : 11/133891
DATED : October 6, 2009
INVENTOR(S) : John A. Dangelewicz et al.

It is certified that error appears in the above-identified patent and that said Letters Patent is hereby corrected as shown below:

In column 15, line 67, in Claim 2, before "is" insert -- sheet --.

In column 16, line 15, in Claim 4, delete "3," and insert -- 3 --, therefor.

In column 16, line 17, in Claim 4, after "members" insert -- when the members --.

In column 16, line 23, in Claim 5, delete "so as" and insert -- so as to --, therefor.

In column 16, line 34, in Claim 7, before "endless" delete "of the".

In column 16, line 39, in Claim 7, delete "engaged" and insert -- engage --, therefor.

In column 16, line 54, in Claim 8, delete "of" and insert -- off --, therefor.

In column 16, line 55, in Claim 9, delete "8," and insert -- 8 --, therefor.

In column 16, line 59, in Claim 9, after "ramp" insert -- to --.

In column 16, line 66, in Claim 10, after "and" insert -- a --.

In column 17, line 14, in Claim 10, before "move" insert -- to --.

In column 17, line 14, in Claim 10, before "off" insert -- sheet --.

In column 18, line 9, in Claim 13, delete "numbers." and insert -- members. --, therefor.

Signed and Sealed this

Eighteenth Day of May, 2010

David J. Kappos

David J. Kappos
*Director of the United States Patent and Trademark Office*